US007817171B2

(12) United States Patent
Shiomi

(10) Patent No.: US 7,817,171 B2
(45) Date of Patent: Oct. 19, 2010

(54) DISPLAY APPARATUS DRIVING METHOD, DISPLAY APPARATUS DRIVING DEVICE, PROGRAM THEREFOR, RECORDING MEDIUM STORING PROGRAM, AND DISPLAY APPARATUS

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 680 days.

(21) Appl. No.: 11/661,811

(22) PCT Filed: Aug. 30, 2005

(86) PCT No.: PCT/JP2005/015720

§ 371 (c)(1),
(2), (4) Date: Sep. 12, 2007

(87) PCT Pub. No.: WO2006/025359

PCT Pub. Date: Mar. 9, 2006

(65) Prior Publication Data

US 2008/0211801 A1 Sep. 4, 2008

(30) Foreign Application Priority Data

Sep. 3, 2004 (JP) ..... 2004-257647

(51) Int. Cl.
*G09G 5/10* (2006.01)
*G09G 3/36* (2006.01)

(52) U.S. Cl. ..... 345/690; 87/89; 87/98

(58) Field of Classification Search ..... 345/87, 345/89, 98–100, 589, 694, 695, 696, 698
See application file for complete search history.

(56) References Cited

U.S. PATENT DOCUMENTS 5,808,697 A 9/1998 Fujimura
6,724,934 B1 4/2004 Lee et al.
6,850,214 B2 * 2/2005 Nishitani et al. ..... 345/87
6,876,764 B2 4/2005 Lee et al.

(Continued)

FOREIGN PATENT DOCUMENTS

EP 1321920 A1 6/2003

(Continued)

*Primary Examiner*—Duc Q Dinh
(74) *Attorney, Agent, or Firm*—Harness, Dickey & Pierce, P.L.C.

(57) ABSTRACT

A control section is disclosed which divides a display screen into small regions, evaluates the relative brightness of each of the small regions in accordance with color data to be inputted as color data by which each pixel is displayed, and determines whether or not the display screen has a first small region that is brighter than the other small regions by a predetermined degree. Furthermore, the control section causes a first generating device to generate gradation data for use in the first small region, and causes a second generating device to generate gradation data for use in the other small regions. Even if the second generating section receives the same color data as the first generating section does, the second generating section limits the luminance of a W sub-pixel as compared to the first generating section. With this, the first small region can be displayed more strikingly brightly, so that a clearer, more realistic, and more appealing image can be displayed. This makes it possible to realize a display apparatus capable of displaying a clearer, more realistic, and more appealing image.

10 Claims, 6 Drawing Sheets

U.S. PATENT DOCUMENTS

| | | | | |
|---|---|---|---|---|
| 6,891,524 | B2 * | 5/2005 | Sakashita | 345/89 |
| 7,518,621 | B2 * | 4/2009 | Kinoshita et al. | 345/690 |
| 2003/0107681 | A1 | 6/2003 | Otawara | |

FOREIGN PATENT DOCUMENTS

| | | | |
|---|---|---|---|
| JP | 02-118521 | | 5/1990 |
| JP | 4-34594 | A | 2/1992 |
| JP | 5-281926 | A | 10/1993 |
| JP | 6-78332 | A | 3/1994 |
| JP | 9-65252 | A | 3/1997 |
| JP | 9-84038 | A | 3/1997 |
| JP | 2001-119714 | | 4/2001 |
| JP | 2002-215094 | A | 7/2002 |
| JP | 2003-198984 | A | 7/2003 |
| JP | 2004-350179 | A | 12/2004 |

* cited by examiner

DISPLAY APPARATUS DRIVING METHOD, DISPLAY APPARATUS DRIVING DEVICE, PROGRAM THEREFOR, RECORDING MEDIUM STORING PROGRAM, AND DISPLAY APPARATUS

TECHNICAL FIELD

The present invention relates to a display apparatus driving method, a display apparatus driving device, a program therefor, a recording medium storing the program, and a display apparatus, each of which allows a display screen of the display apparatus to display a clearer, more realistic, and more appealing image.

BACKGROUND ART

Liquid crystal display apparatuses that can be driven with a comparatively small amount of power have been widely used not only as image display apparatuses to be provided in stationary apparatuses but also as image display apparatuses to be provided in portable phones. Among these liquid crystal display apparatuses, there is a liquid crystal display apparatus in which a gradation to be displayed by a pixel is controlled by (i) supplying, to a data signal line driving circuit, a digital signal indicating a gradation of each pixel and (ii) causing the data signal line driving circuit to apply, to a data signal line, a voltage corresponding to a value of the digital signal.

In a liquid crystal display apparatus, the transmission of light emitted from a backlight is adjusted by adjusting the way a liquid crystal layer polarizes light. This causes deterioration in efficiency in the use of light as compared with a CRT (cathode-ray tube) using direct fluorescence emission. Furthermore, a color filter is used for a color display. This causes further deterioration in efficiency in the use of light by the liquid crystal display.

In order to solve this problem, Patent Document 1 (Japanese Unexamined Patent Publication No. 118521/1990 (Tokukaihei 2-118521; published on May 2, 1990)) discloses a technique of improving transmittance in a white state by providing pixels each including not only R (red), G (green), and B (blue) sub-pixels but also a W (white) sub-pixel that uses no color filter.

For example, the W sub-pixel is set to have a gradation level smaller than those of the R, G, and B sub-pixels, and the R, G, and B sub-pixels are corrected to have gradations corresponding to differences between the luminance of the W sub-pixel and the luminances of the R, G, and B sub-pixels, respectively. This makes it possible to realize an entirely bright display.

DISCLOSURE OF INVENTION

However, even if an entirely bright display is realized by the foregoing conventional arrangement, a strikingly bright region may not be displayed brightly enough as compared with a CRT (cathode-ray tube). This causes such a problem that an image to be displayed may become less clear, less realistic, and less appealing.

The present invention has been made in view of the foregoing problems, and it is an object of the present invention to provide a display apparatus driving method, a display apparatus driving device, a program therefor, a recording medium storing the program, and a display apparatus, each of which allows a display screen of the display apparatus to display a clearer, more realistic, and more appealing image.

In order to solve the foregoing problems, a method according to the present invention for driving a display apparatus includes a dividing step of dividing a display region into small regions and a controlling step of controlling a gradation luminance characteristic of each of the small regions, the method, including: a judging step of (i) evaluating, in accordance with an input signal by which each pixel is displayed, a relative brightness of each of the small regions into which the display region has been divided, and (ii) judging whether or not a display screen has a first small region that is brighter by a predetermined degree than other small regions, in the controlling step, a gradation luminance characteristic of each of the small regions being controlled so that (a) a white luminance of each of the small regions which white luminance is obtained when it is judged that the display screen has no first small region becomes lower than that of the first small region and (b) a white luminance of each of small regions other than a first small region which white luminance is obtained when it is judged the display screen has the first small region becomes lower than that of the first small region.

Further, in order to solve the foregoing problems, a device according to the present invention for driving an display apparatus includes control means for dividing a display region into small regions, and for controlling a gradation luminance characteristic of each of the small regions, the device, including: judging means for (i) evaluating, in accordance with an input signal by which each pixel is displayed, a relative brightness of each of the small regions into which the display region has been divided, and (ii) judging whether or not a display screen has a first small region that is brighter by a predetermined degree than other small regions, the control means controlling a gradation luminance characteristic of each of the small regions so that (a) a white luminance of each of the small regions which white luminance is obtained when it is judged that the display screen has no first small region becomes lower than that of the first small region and (b) a white luminance of each of small regions other than a first small region which white luminance is obtained when it is judged the display screen has the first small region becomes lower than that of the first small region.

According to the foregoing arrangement, in cases where the display screen has a first small region that is brighter than the other small regions by a predetermined degree, the white luminance of the first small region can be made higher than the white luminance of each of the small regions which white luminance is obtained when it is judged that the display screen has no first small region, and the white luminance of the first small region can be made higher than the white luminance of each of the other small regions which white luminance is obtained when it is judged the display screen has the first small region.

Therefore, in cases where a display of an image containing a strikingly bright small region (first small region) is indicated, the small region can be displayed more strikingly brightly than (i) the other regions of the image and (ii) each small region of the image which small region contains no strikingly bright small region, so that the image can be displayed with a high contrast ratio. This allows the display screen of the display apparatus to display a clearer, more realistic, and more appealing image.

Further, in order to solve the foregoing problems, a device according to the present invention for driving a display apparatus includes a display screen which has a plurality of pixels, each of the pixels having a plurality of sub-pixels for displaying different colors in accordance with (i) whether a color filter is provided or (ii) a color of the color filter, specific one of the sub-pixels, which constitute each of the pixels, displaying a color that is able to be displayed by one or more sub-pixels other than the specific sub-pixel, the device, including: first generating means for generating, in accordance with an input signal indicative of a color to be displayed by each of the pixels, a signal for driving each of the sub-pixels; second generating means for generating, in accordance with an input signal indicative of a color to be displayed by each of the pixels, a signal for driving each of the sub-pixels so as to limit a luminance of the specific sub-pixel as compared to the first generating means, the input signals being identical to each other, control means for (a) dividing the display screen into small regions, (b) evaluating a relative brightness of each of the small regions in accordance with an input signal by which each of the pixels is displayed, (c) judging whether or not the display screen has a first small region that is brighter by a predetermined degree than other small regions, (d) causing the first generating means to generate a signal for driving a sub-pixel contained in the first small region, and (e) causing the second generating means to generate a signal for driving a sub-pixel contained in each of other remaining small regions.

According to the foregoing arrangement, in cases where the display screen is divided into a plurality of small regions, where the relative brightness of each of the small regions is evaluated, and where the display screen has a first small region that is brighter than the other small regions by a predetermined degree (e.g., in cases where an image containing a strikingly bright portion is displayed), the control means causes the first generating means to generate a signal for driving a sub-pixel of the first small region, and causes the second generating means to generate a signal for driving a sub-pixel of the residual small region (second small region).

Further, in cases where there is no first small region (e.g., in cases where an image having no strikingly bright portion is displayed), the control means causes the second generating means to generate a signal for driving a sub-pixel of each small region (second small region) of the display screen.

Here, when the second generating means generates a signal for driving the sub-pixel, the second generating means controls the luminance of the specific sub-pixel as compared to the first generating means. Therefore, as compared with a case where a sub-pixel of the first small region and a sub-pixel of the second small region are driven by a signal generated by the same generating means, the relative brightness of the first small region with respect to the second small region can be increased. Further, even as compared with a case where a display of an image containing no strikingly bright small region is indicated, i.e., a case where all sub-pixels are driven by a signal generated by the second generating means, the relative brightness of the first small region can be increased.

As a result, in cases where a display of an image containing a strikingly bright small region (first small region) is indicated, the small region can be displayed more strikingly brightly than (i) the second small region of the image and (ii) each small region (second small region) of an image containing no strikingly bright small region, so that the image can be displayed with a high contrast ratio. This allows the display screen of the display apparatus to display a clearer, more realistic, and more appealing image.

Further, in addition to the foregoing arrangement, each of the pixels may include a W (white) sub-pixel serving as a specific sub-pixel, an R (red) sub-pixel, a G (green) sub-pixel, and a B (blue) sub-pixel. According to this arrangement, the pixel includes the R, G, B, and W sub-pixels, so that it is possible to display any color by controlling the luminance of each of the sub-pixels. Further, the white sub-pixel is contained as the specific sub-pixel, so that the brightness can be improved as compared to any other color. This allows the display screen of the display apparatus to display a clearer, more realistic, and more appealing image.

Furthermore, in addition to the foregoing arrangement, the device may be arranged such that: the second generating means resets a gradation signal indicative of a luminance of the W sub-pixel to a predetermined value for use in a dark display; and the first generating means sets a gradation signal indicative of a luminance of the W sub-pixel to a value, indicated by the input signal, which varies depending on a luminance of a pixel containing the W sub-pixel.

According to this arrangement, in cases where the second generating means instructs the W sub-pixel to carry out a dark display and the W sub-pixel is driven by a gradation signal generated by the first generating section, the luminance of the W sub-pixel is set to be not less than a value indicating the dark display, so that the first small region can be made brighter than the second small region. This allows the display screen of the display apparatus to display a clearer, more realistic, and more appealing image.

Further, in addition to the foregoing arrangement, the first generating means has a $\gamma$ characteristic whose $\gamma$ value is set to be greater than that of the second generating means. According to this arrangement, the $\gamma$ value of the signal generated by the first generating means is set to be larger than the $\gamma$ value of the signal generated by the second generating means, so that the luminance of a sub-pixel of the first small region can be changed more rapidly when the signal generated by the first generating section is changed. As a result, the first small region can be displayed more strikingly brightly. This allows the display screen of the display apparatus to display a clearer, more realistic, and more appealing image.

Furthermore, in addition to the foregoing arrangement, the device may be arranged such that: the control means judges, as the first small region, a small region in which a proportion of pixels each having a luminance that is higher by a predetermined level than an in-plane average luminance of the display screen is not less than a predetermined proportion.

According to this arrangement, a first small region is judged in the foregoing manner, so that a strikingly bright small region can be judged as the first small region. This allows the display screen of the display apparatus to display a clearer, more realistic, and more appealing image.

Further, in addition to the foregoing arrangement, the device may be arranged such that: the control means changes the predetermined level in accordance with a standard deviation in luminance of each of the pixels in the display screen.

According to this arrangement, the predetermined level is changed in accordance with the standard deviation. Therefore, as compared with a case where the predetermined level is fixed, it is possible to accurately judge a first small region even in cases where more various types of image are displayed. Therefore, even in cases where the more various types of image are displayed, it is possible to cause the display screen of the display apparatus to display those images as clearer, more realistic, and more appealing images without problems.

In case of an image, such as an almost monotone image, in which even a small region slightly brighter than the other small regions seems to be a strikingly bright small region, the standard deviation is small. Therefore, the small region can be judged as a first small region by setting the predetermined level to be lower than that set when the standard deviation is large.

On the other hand, in cases where an image having a large standard deviation is displayed, the level is set to be higher than that set when the standard deviation is small. Then, it can be judged that the small region judged to be a first small region in the case of the almost monotone image is not a first small region, so that it is possible to avoid a situation in which the display screen always has a large number of first small regions. Here, in cases where the display screen always has a large number of first small regions, the following problem may be caused. That is, the influence of a process for the first small regions is reflected, so that display characteristics such as a color balance and a tone curve deviate from the desired characteristics.

However, according to the foregoing arrangement, the situation in which the display screen always has a large number of first small regions can be avoided by setting, when an image having a large standard deviation is displayed, the level to be lower than that set when the standard deviation is small. This makes it possible to prevent deterioration in display characteristics.

Furthermore, in addition to the foregoing arrangement, the device may be arranged such that: when the pixels have a luminance lower than a predetermined value, the control means treats the pixels to have a luminance of not more than the predetermined level, regardless of a result of evaluating the luminance of the pixel with respect to the in-plane average luminance.

According to this arrangement, regardless of the result of evaluating the in-plane average luminance, a pixel having a luminance not more than a predetermined value is treated as a pixel whose level with respect to the in-plane average luminance is not more than the predetermined level. This makes it possible to prevent the following problem: As a result of judging an inappropriate pixel as a high-luminance pixel due to a statistical error, a small region that cannot be said to be strikingly bright is misjudged as a first small region.

Furthermore, in addition to the foregoing arrangement, the device may be arranged such that: the control means (i) divides each of the small regions into small blocks each including a plurality of pixels, and (ii) makes a judgment in accordance with an average luminance of each of the small blocks instead of the luminance of the pixel.

According to this arrangement, the proportion occupied in the small region is calculated not in units of a pixel but in units of a small block larger than the pixel. Therefore, as compared with the calculation in units of the pixel, the amount of calculation needed for calculating the proportion and the size of a circuit needed for the calculation can be reduced. The size of the small block is especially preferably 8×8 pixels. This is because an error in calculating the proportion can be reduced.

Furthermore, in addition to the foregoing arrangement, the control means may make, on a gradation value basis, a judgment for each of the small regions as to whether or not the small region is a first small region. According to this arrangement, the judgment as to whether or not the small region is a first small region is made not on the basis of a luminance value but on the basis of a gradation value, so that the control means does not need to convert, into a luminance value, an input signal inputted as a gradation value, and can judge whether or not the small region is a first small region. Therefore, the amount of calculation needed for the judgment and the size of a circuit needed for making the judgment can be reduced. In cases where the judgment as to whether or not the small region is a first small region is made on the basis of a gradation value, it is difficult to accurately calculate the relative brightness of each of the small regions. However, even when the judgment is made on the basis of a gradation value, the control means can calculate the relative brightness of each of the small regions with accuracy sufficient to make a judgment as to which of the first and second generating means should generate a signal for driving a sub-pixel contained in each of the small regions. Further, in cases where the judgment is made on the basis of a gradation value, preferable example of the predetermined level is twice as high as the in-plane average luminance.

Further, in addition to the foregoing arrangement, the small region occupies, in the display screen, 1/64 or smaller of an area of the display screen. According to this arrangement, since the area of the small region is set as described above, it is possible to prevent such a problem that the occurrence of block separation causes deterioration in display quality. The block separation is a phenomenon in which a lengthening of a border between small regions causes the border between the small regions to be easily noticeable as a change in luminance due to a difference in driving method between the first and second small regions (difference in method of producing gradation data D2). Further, since the area of the small region is set as described above, the number of pixels contained in the small region becomes larger, so that it is possible to prevent such a problem that the judgment becomes complicated.

Further, in order to solve the foregoing problems, a method according to the present invention for driving a display apparatus includes a dividing step of dividing a display region into a plurality of small regions and a controlling step of controlling a gradation luminance characteristic of each of the small regions, in the controlling step, the gradation luminance characteristic of each of the small regions being controlled so that a first-zone white gradation luminance becomes higher when a second-zone gradation indicates black than white, where: (i) the first zone is an area containing at least one of the small regions in the display region and (ii) the second zone is a predetermined area in the display region which area is larger than the first zone, and which area has a luminance capable of representing a luminance of the entire display region, and the first-zone white gradation luminance is a luminance of the first zone obtained when a video signal is supplied for causing the first zone to display white and for causing the second zone to display a preset second-zone gradation.

Further, a device according to the present invention for driving a display apparatus includes control means for dividing a display region into a plurality of small regions, and for controlling a gradation luminance characteristic of each of the small regions, the control means controlling the gradation luminance characteristic of each of the small regions so that a first-zone white gradation luminance becomes higher when a second-zone gradation indicates black than white, where: (i) the first zone is an area containing at least one of the small regions in the display region and (ii) the second zone is a predetermined area in the display region which area is larger than the first zone, and which area has a luminance capable of representing a luminance of the entire display region, and the first-zone gradation luminance is a luminance of the first zone obtained when a video signal is supplied for causing the first zone to display white and for causing the second zone to display a preset second-zone gradation.

According to these arrangements, the first-zone white gradation luminance is controlled more greatly when the second-zone gradation considered to be approximately representative of the luminance of the entire display area indicates black than when the second-zone gradation indicates white. Therefore, in cases where the first zone is strikingly bright, where the gradation of the first zone indicates white, and where the gradation of the second zone indicates black, the first zone can be displayed even more brightly. As a result, in cases where the first zone is strikingly bright, where the gradation of the first zone indicates white, and where the gradation of the second zone indicates black, the first zone can be displayed more strikingly brightly as compared with the other regions. Further, in cases where the first zone is strikingly bright, where the gradation of the first zone indicates white, and where the gradation of the second zone indicates black, the first zone is displayed more brightly than when both the gradations of the first and second zones indicate white. Therefore, in cases where the first zone is strikingly bright, where the gradation of the first zone indicates white, and where the gradation of the second zone indicates black, the image can be displayed with a high contrast ratio, so that the image can be displayed with a high contrast ratio. This allows the display screen of the display apparatus to display a clearer, more realistic, and more appealing image.

Furthermore, in addition to the foregoing arrangement, the method may be arranged such that: in the controlling step, the gradation luminance characteristic of each of the small regions is controlled so that the first-zone white gradation luminance becomes higher (i) when the second-zone gradation indicates a gradation that is lower than a predetermined gradation than (ii) when the second-zone gradation indicates white.

Thus, the first-zone white gradation luminance is controlled so as to be higher when the second-zone gradation indicates the gradation lower than the predetermined gradation, as well as when the second-zone gradation indicates black, than when the second-zone gradation indicates white. With this, when the white luminance of the first zone is higher than the luminance of the second zone by a certain degree or higher, the white luminance of the first zone can be made even higher, so that the first zone can be displayed more clearly.

Further, in addition to the foregoing arrangement, the method may be arranged such that: in the controlling step, when a video signal is inputted for causing the entire display region to display an identical gradation, a gradation luminance characteristic of the first zone and a gradation luminance characteristic of the second zone are controlled so that a $\gamma$ characteristic having a predetermined first $\gamma$ value is obtained; and when the second-zone gradation indicates a gradation lower than the predetermined gradation, the gradation luminance characteristic of the first zone is controlled so that a $\gamma$ characteristic having a predetermined second $\gamma$ value not smaller than the first $\gamma$ value is obtained.

According to this arrangement, when the second-zone gradation indicates the gradation lower than the predetermined gradation, the gradation luminance characteristic of the first zone is controlled so that the $\gamma$ characteristic having the second $\gamma$ value is obtained. Therefore, the luminance of each pixel contained in the first zone can be changed more rapidly. As a result, the first zone can be displayed more strikingly brightly. This allows the display screen of the display apparatus to display a clearer, more realistic, and more appealing image.

Incidentally, the device for driving a display apparatus may be realized by using hardware, or may be realized by causing a computer to execute a program. Specifically, a program according to the present invention is a program for causing a computer to operate as means of the device for driving a display apparatus, and a recording medium according to the present invention stores the program.

When these programs are executed by a computer, the computer operates as the device for driving a display apparatus. Therefore, as with the device for driving a display apparatus, a strikingly bright small region (first small region) can be displayed more strikingly brightly, so that an image containing the small region can be displayed with a high contrast ratio. This allows the display screen of the display apparatus to display a clearer, more realistic, and more appealing image.

Further, a display apparatus according to the present invention includes any one of the devices for driving a display apparatus. Therefore, as with the device for driving a display apparatus, a strikingly bright small region (first small region) can be displayed more strikingly brightly, so that an image containing the small region can be displayed with a high contrast ratio. This allows the display screen of the display apparatus to display a clearer, more realistic, and more appealing image.

Furthermore, in addition to the foregoing arrangement, the display apparatus according to the present invention may be a television receiver using liquid crystals as the pixels. Further, in addition to the foregoing arrangement, the display apparatus according to the present invention may be a liquid crystal monitor apparatus, using liquid crystal as the pixels, which displays a video signal.

Here, at present, a liquid crystal cell can ensure an average luminance not less than that ensured by a CRT (cathode-ray tube), but tends to lack in peak luminance. Therefore, a display apparatus including the device for driving a display apparatus can be suitably used as a liquid crystal television receiver or a liquid crystal monitor apparatus.

Thus, the present invention allows a strikingly bright small region (first small region) to be displayed more strikingly brightly, and allows a display screen of a display apparatus to display a clearer, more realistic, and more appealing image. Therefore, the present invention can be suitably used for driving various display apparatuses such as a liquid crystal television receiver and a liquid-crystal monitor apparatus.

BEST MODE FOR CARRYING OUT THE INVENTION

Embodiment 1

An embodiment of the present invention will be described below with reference to FIGS. 1 through 7. That is, an image display apparatus 1 according to the present embodiment is an image display apparatus capable of causing a display screen of a display apparatus to display a clearer, more realistic, and more appealing image (sharper image), and can be suitably used, for example, as an image display apparatus of a television receiver or a monitor apparatus of a computer. Note that examples of television broadcasts to be received by the television receiver include: terrestrial television broadcasts; broadcasts, such as BS (Broadcasting Satellite) digital broadcasts and CS (Communication Satellite) digital broadcasts, which uses satellites; and cable television broadcasts.

Figure 2:
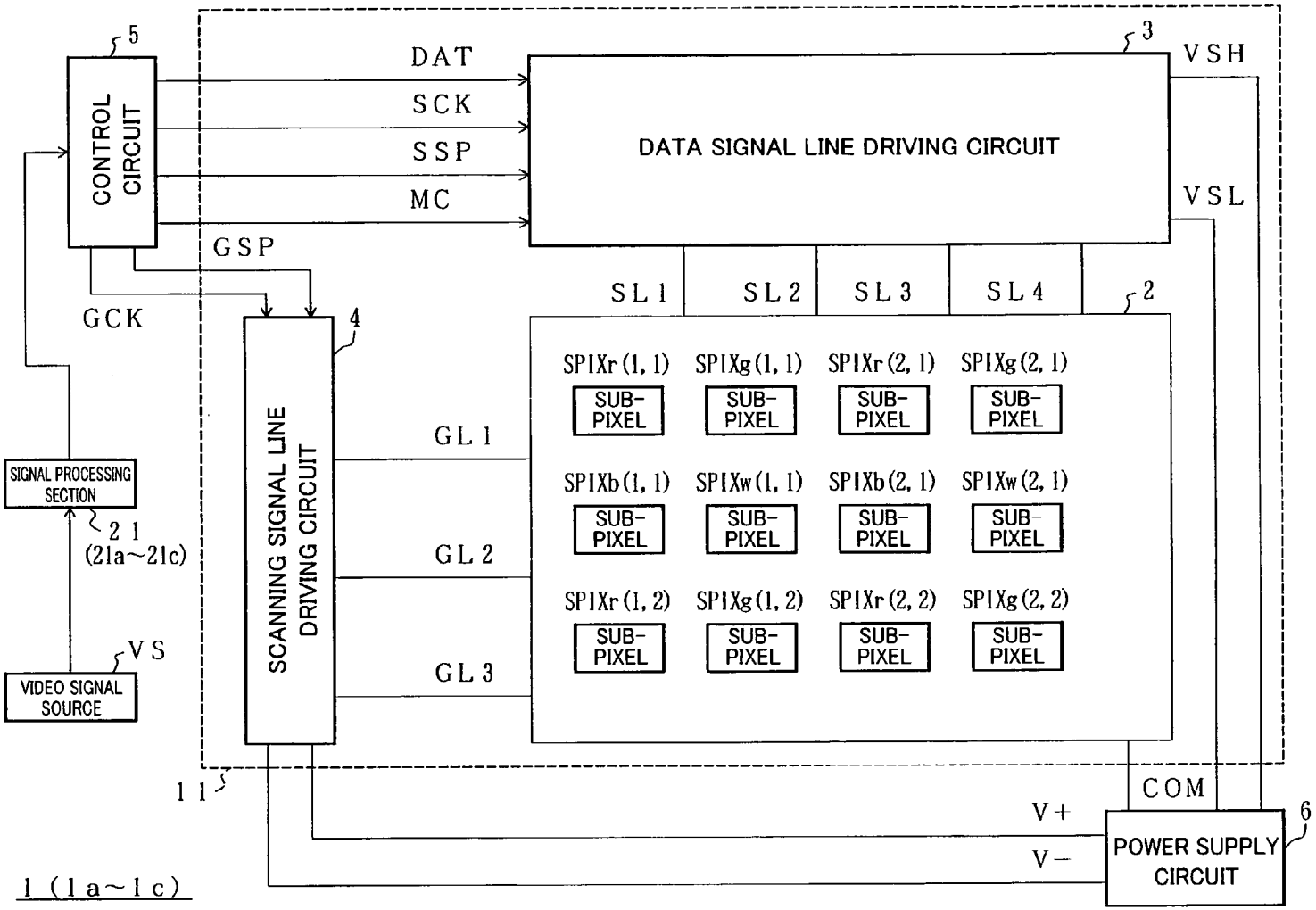
FIG. 2 is a block diagram showing an arrangement of a main portion of the image display apparatus.

The image display apparatus 1 has a pixel which includes sub-pixels capable of displaying R (red), G (green), B (blue), and W (white), respectively, and is a display apparatus that can carry out a color display by controlling the luminance of each of the sub-pixels. For example, as shown in FIG. 2, the image display apparatus 1 includes: a pixel array 2, which has pixels PIX(1,1) to PIX(n,m) arrayed in a matrix manner; a data signal line driving circuit 3, which drives a sub-pixel constituting each of the pixels PIX(1,1) to PIX(n,m); and a scanning signal line driving circuit 4.

Furthermore, the image display apparatus 1 includes a signal processing section 2 and a control circuit 5. The signal processing section 2 receives, from a video signal source VS, a video signal DAT1 indicating a color of each of the pixels PIX(1,1) to PIX(n,m), and generates, in accordance with the video signal DAT1, a video signal DAT2 indicating the luminance of the sub-pixel constituting each of the pixels PIX(1,1) to PIX(n,m). The control circuit 5 supplies control signals to the driving circuits 3 and 4 in accordance with the video signal DAT2. The members (e.g., the members 3 to 5 and 21) of the image display apparatus 1 are operated by power supplied from a power supply 6 of the image display apparatus 1. Further, in the present embodiment, for example, the pixel array 2, the data signal line driving circuit 3, and the scanning signal line driving circuit 4 constitute a panel 11.

In the following, the schematic arrangement and operation of the entire image display apparatus 1 are briefly explained before the detailed arrangement and operation of the signal processing section 21 are explained. Further, in the following, for convenience of explanation, only in cases where the location of a pixel needs to be specified is the pixel given a number or alphabet character indicating the location of the pixel. For example, the pixel is referred to as "pixel PIX(i,j)" when the pixel is the ith pixel as counted from upper left in a row direction and the jth pixel as counted from upper left in a column direction. In cases where the location of the pixel does not need to be specified or in cases where the pixel is generally referred to, the pixel is not given a character indicating the location of the pixel. For example, the pixel is referred to simply as "pixel PIX". Similarly, in cases where the color of a sub-pixel needs to be specified, the sub-pixel is given a character indicating the color of the sub-pixel. For example, the sub-pixel is referred to as "sub-pixel SPIXr(i,j)". In cases where the color of the sub-pixel does not need to be specified or in cases where the sub-pixel is generally referred to, the sub-pixel is not given a character indicating the color of the sub-pixel. For example, the sub-pixel is referred to simply as "sub-pixel SPIX(i,j).

Figure 3:
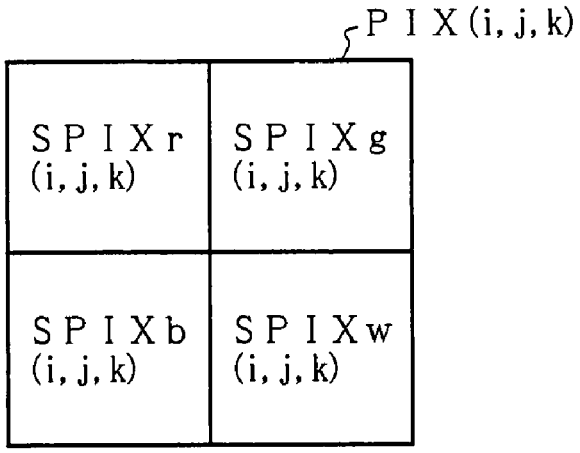
FIG. 3 is a plain view showing an example of how sub-pixels are arrayed in a pixel of the image display apparatus.
Figure 4:
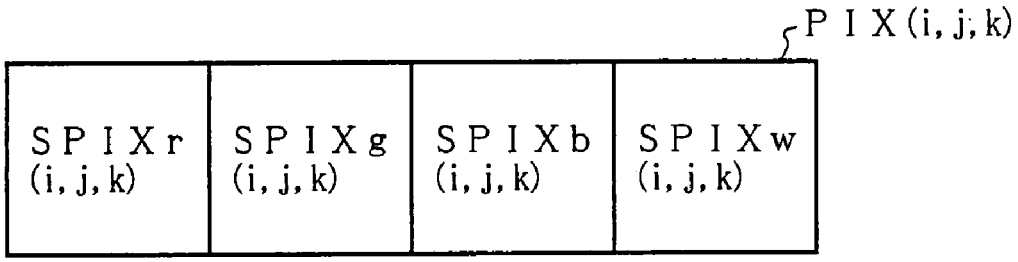
FIG. 4 is a plain view showing another example of how the sub-pixels are arrayed in the pixel of the image display apparatus.

For example, as shown in FIG. 3 or 4, each pixel PIX(i,j) according to the present embodiment includes sub-pixels SPIXr(i,j), SPIXg(i,j), SPIXb(i,j), and SPIXw(i,j) respectively corresponding to R (red), G (green), B (blue), and W (white).

The sub-pixels SPIX(i,j) may be arrayed in any way as long as they are arrayed so that the color of the pixel PIX(i,j) can be adjusted by adjusting the respective luminances of the sub-pixels SPIX(i,j), i.e., so that the colors are mixed together in an additive process. FIG. 3 shows an example in which the sub-pixels SPIX(i,j) respectively corresponding to R, G, B, and W are arrayed 2×2 in a matrix manner. FIG. 4 shows an example in which the sub-pixels SPIX(i,j) respectively corresponding to R, G, B, and W are arrayed in one direction (In the example shown in FIG. 4, the direction is a direction extending along scanning signal lines GL described later.) in the order shown in FIG. 4.

Further, the pixel array 2 includes a plurality of data signal lines SL and a plurality of scanning signal lines GL each crossing each of the data signal lines SL, and any one of the sub-pixels SPIX is provided for each combination of a data signal line SL(i) and a scanning signal line GL(j). The number of data signal lines SL and the number of scanning signal lines GL are set so that all the sub-pixels SPIX can correspond to any one of combinations of a data signal line and a scanning signal line. (In FIG. 3, the number of data signal lines SL is n×2, and the number of scanning signal lines GL is m×2. In FIG. 4, the number of data signal lines SL is n×4, and the number of scanning signal lines GL is m.).

Figure 5:
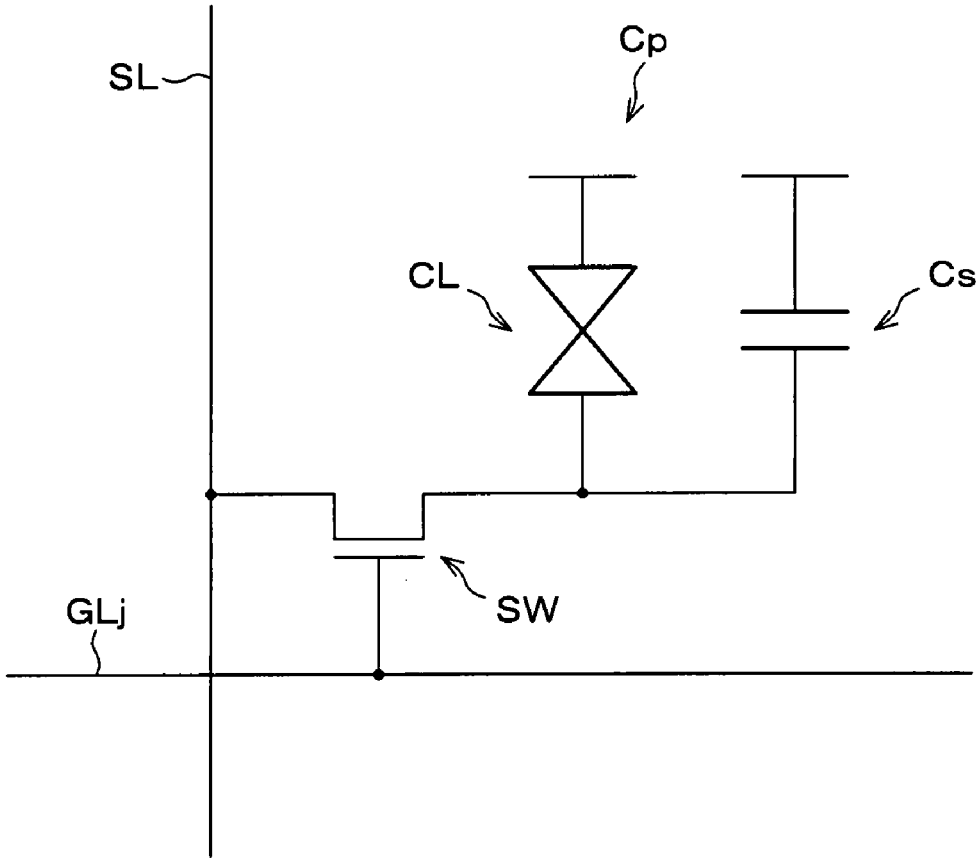
FIG. 5 is a circuit diagram showing an example of how the pixel is arranged.

See an example in which the image display apparatus 1 serves as a liquid crystal display apparatus. In this example, as shown in FIG. 5, each of the sub-pixels SPIX includes (i) a field-effect transistor SW serving as a switching element and (ii) a pixel capacitor Cp having one electrode connected to a source of the field-effect transistor SW. Further, the field-effect transistor SW has (a) a drain connected to a data signal line SL corresponding to the sub-pixel SPIX and (b) a gate connected to a scanning signal line GL corresponding to the sub-pixel SPIX. Furthermore, the pixel capacitor Cp has another end connected to a common electrode line common to all the sub-pixels SPIX . . . The pixel capacitor Cp includes a liquid crystal capacitor CL and a supplementary capacitor Cs that is to be added as required.

In the sub-pixel SPIX, when the scanning signal line GL corresponding to the sub-pixel SPIX is selected, the field-effect transistor SW becomes conductive, so that a voltage applied to the data signal line SL corresponding to the sub-pixel SPIX is applied to the pixel capacitor Cp. On the other hand, when the select period of the scanning signal line GL ends, the field-effect transistor SW is turned off. While the field-effect transistor is off, the pixel capacitor Cp continues to retain the voltage applied thereto when the field-effect transistor SW was turned off. The transmittance and reflectance of liquid crystals change depending on a voltage applied to the liquid crystal capacitor CL. Therefore, when the scanning signal line GL is selected and an output signal (a voltage signal, in case of liquid crystals) corresponding to image data indicating the luminance of the sub-pixel SPIX is applied to the data signal line SL, a display state of the sub-pixel SPIX can be changed in accordance with the image data.

The liquid crystal display apparatus according to the present embodiment employs a homeotropic-mode liquid-crystal cell as a liquid crystal cell. Specifically, in the homeotropic-mode liquid-crystal cell, liquid crystalline molecules are aligned substantially perpendicularly to the substrate when no voltage is applied. The liquid crystalline molecules are tilted out of the homeotropic alignment in accordance with the voltage applied to the liquid crystal capacitor CL of the sub-pixel SPIX. The liquid crystal cell is used in a normally black mode (a mode in which a black display is carried out when no voltage is applied).

According to the foregoing arrangement, the scanning signal line driving circuit 4 shown in FIG. 2 sends, to each of the scanning signal lines GL, a signal, such as a voltage signal, which indicates whether or not the scanning signal line GL is in a select period. Further, the scanning signal lines driving circuit 4 selects, in accordance with a timing signal, such as a clock signal GCK or a start pulse signal GSP, which is supplied from the control circuit 5, a scanning signal line GL to which a signal indicating a select period is to be sent. With this, the scanning signal lines GL are sequentially switched over to one another at a predetermined timing.

Furthermore, for example, the data signal line driving circuit 3 samples, at a predetermined timing, image data to be respectively inputted as the video signal DAT2 to the sub-pixels SPIX in a time-sharing manner, thereby extracting the image data. Furthermore, the data signal lines driving device 3 outputs signals corresponding to the image data to be respectively inputted to the sub-pixels SPIX. The signals thus outputted are sent, via the data signal lines SL respectively corresponding to the sub-pixels SPIX, to the sub-pixels SPIX corresponding to the scanning signal line GL currently selected by the scanning signal line driving circuit 4.

The data signal line driving circuit 3 determines, in accordance with a timing signal, such as a clock signal SCK or a start pulse signal SSP, which is supplied from the control circuit 5, a timing at which the sampling is carried out and timings at which the signals are outputted.

Meanwhile, the brightness of each of the sub-pixels SPIX connected to the scanning signal line GL currently selected is determined in the following manner. That is, while the scanning signal line GLi is being selected, the luminance, transmittance, or the like of the sub-pixel SPIX emitting light are adjusted in accordance with an output signal supplied to a data signal line SL corresponding to the sub-pixel SPIX.

Here, the scanning signal line driving circuit 4 sequentially selects any one of the plurality of scanning signal lines GL. Therefore, each of the sub-pixels SPIX constituting all the pixels of the pixel array 2 can be set to have the brightness (gradation) indicated by gradation data to be respectively inputted to the sub-pixels SPIX, so that an image to be displayed by the pixels array 2 can be renewed.

As will be fully described later, the video signal DAT1 outputted by the video signal source VS and the video signal DAT2 outputted by the signal processing section 21 may be in any signal format as long as they are in a signal format capable of containing (i) information for the data signal line driving device 3 to indicate a display state of each of the sub-pixels SPIX in each frame period and (ii) information for relatively comparing the brightnesses of small regions contained in the display screen. In the following, for example, the video signal DAT1 contains color data of all the pixels PIX for each frame period, and the video signal DAT2 contains gradation data indicative of the luminances of all the sub-pixels SPIX for each frame period.

More specifically, the video signal source VS repeats, for each frame period, such an operation that color data D1 of all the pixels PIX in the frame are outputted. For example, the video signal source VS according to the present embodiment transmits the color data D1 in a time-sharing manner, and sequentially outputs the color data D1 of all the pixels PIX in a predetermined order in each frame.

Further, in the present embodiment, color data D1(i,j,k) of a pixel PIX (i,j) in a frame FR(k) is expressed by an RGB color system, and contains gradation data R1(i,j,k), G1(i,j,k), and B1(i,j,k) indicating the respective luminances of R, G, and B. Furthermore, in the present embodiment, each of the gradation data R1(i,j,k), G1(i,j,k), and B1(i,j,k) is expressed as gradation data having a gamma value of 2.2.

Meanwhile, the signal processing section 21 repeats, for each frame period, such an operation that gradation data (R2, G2, B2, or W2) indicating the luminances of all the sub-pixels SPIX are outputted. Further, for example, the signal processing section 21 according to the present embodiment transmits the gradation data R2, G2, B2, and W2 in a time-sharing manner, and sequentially outputs the gradation data (R2, G2, B2, or W2) of all the sub-pixels SPIX in a predetermined order in each frame. The gradation data R2, G2, B2, and W2 are gradation data to be inputted to the sub-pixels SPIX corresponding to R, G, B, and W, respectively. In the following, the entire gradation data to be inputted to sub-pixels SPIX constituting a pixel PIX is referred to as "gradation data D2".

Furthermore, in generating gradation data D2 to be inputted to sub-pixels SPIX contained in each of the small regions of the display screen, the signal processing section 21 according to the present embodiment can change, in accordance with whether or not the small region is a strikingly bright small region in the display screen, a method for generating gradation data D2. The preferable size of the small region will be described later.

Specifically, the signal processing section 21 according to the present embodiment includes a first generating section 31, a second generating section 32, and a control section 33. The first generating section 31 generates gradation data D2(i,j,k) from color data D1(i,j,k) of a pixel PIX(i,j) in accordance with a first generating method predetermined as a generating method for a strikingly bright small region. The second generating section 32 generates gradation data D2(i,j,k) from color data D1i,j,k) of a pixel PIX(i,j) in accordance with a second generating method predetermined as a generating method for remaining small regions. The control section 33 (i) makes, in accordance with the video signal DAT1, a judgment for each of the small regions as to whether or not the small region is a strikingly bright small region in the display screen, and (ii) controls, in accordance with a result of the judgment made with respect to the small region, whether the gradation data D2(i,j,k) generated by the first generating sections 31 or the gradation data D2(i,j,k) generated by the second generating section 32 is outputted as gradation data D2(i,j,k) for a pixel PIX(i,j) contained in the small region.

The first generating section 31 according to the present embodiment can set, as gradation data indicating the luminance of a pixel PIX(i,j) which luminance is calculated from color data D1(i,j,k), gradation data W2(i,j,k) to be inputted to a W sub-pixel SPIXw(i,j). Further, according to the first generating section 31, gradation data R2(i,j,k), G2(i,j,k), and B2(i,j,k) to be inputted to the R, G, and B sub-pixels SPIX can be set to have values equal to those of the gradation data R1(i,j,k), R1(i,j,k), and B1(i,j,k) contained in the color data D1(i,j,k), respectively.

Further, according to the second generating section 32, whereas the gradation data R2(i,j,k), G2(i,j,k), and B2(i,j,k) are set in the same manner as set by the first generating section 31, the gradation data W2(i,j,k) to be inputted to the W sub-pixel SPIXw(i,j) can be set to have a value predetermined for a dark display (e.g., a value of 0 indicating black).

According to the gradation data D2(i,j,k) generated by the first generating section 31, unlike the gradation data D2 (i,j,k) generated by the second generating section 32, the gradation data W2(i,j,k) to be inputted to the W sub-pixel SPIXw(i,j) has not been reset. Therefore, when the first and second generating sections 31 and 32 receive color data D1(i,j,k) identical to each other, the luminance of a pixel PIX(i,j) to be driven by the gradation data D2(i,j,k) generated by the first generating section 31 can be made higher than the luminance of a pixel PIX(i,j) to be driven by the gradation data D2(i,j,k) generated by the second generating section 32.

Meanwhile, the control section 33 according to the present embodiment carries out the following judgment with respect to each of the small regions obtained by dividing the display screen into regions each having a predetermined area, thereby judging whether or not the small regions is a strikingly bright small region. That is, supposing that pixels, each of which indicates a luminance higher than the average luminance Lave (in-plane average luminance) of the display screen by a predetermined level, among the pixels PIX(i,j) contained in the small region are high-luminance pixels, the control section 33 judges, in accordance with whether or not the proportion of the high-luminance pixels in the small region is greater than a predetermined proportion, whether or not the small region is strikingly bright. Preferred examples of the level include a level obtained by multiplying the in-plane average luminance by approximately 5 on the basis of a luminance value (by approximately 2 on a gradation-value basis of a γ value of 2.2).

Furthermore, the control section 33 outputs gradation data D2(i,j,k) of each pixel PIX(i,j) in the following manner. That is, in cases where the control section 33 judges that a small region containing the pixel PIX(i,j) is a strikingly bright small region (the proportion is higher than the predetermined proportion), the control section 33 causes, for example, by instructing the first generating section 31 to output gradation data D2(i,j), the first generating section 31 to output the gradation data D2(i,j) generated by the first generating means 31. Otherwise, the control section 33 causes, for example, by instructing the second generating section 32 to output the gradation data D2(i,j), the second generating section 32 to output the gradation data D2(i,j) generated by the second generating means 32.

The control section 33 according to the present embodiment calculates a luminance from the color data D1(i,j,k) of each pixel PIX(i,j) in carrying out the aforementioned judgment, and includes a luminance calculating section 41, an average luminance calculating section 42, and a judging section 43. The luminance calculating section 41 calculates, from the color data D1(i,j,k) of each pixel PIX(i,j), a luminance L(i,j,k) indicated to the pixel PIX(i,j) in the current frame FR(k). The average luminance calculating section 42 calculates the average luminance Lave of the display screen in accordance with the luminance L of each pixel PIX which luminance is calculated by the luminance calculating section 41. The judging means 43 (i) carries out the aforementioned judgment in accordance with (a) the luminance L(i,j,k) of each pixel PIX(i,j) contained in a small region, from among the luminance L(i,j,k) of the pixel PIX(i,j) which luminance L(i,j,k) is calculated by the luminance calculating section 41, and (b) the average luminance Lave calculated by the average luminance calculating section 42, and (ii) controls the first and second generating sections 31 and 32 in accordance with a result of the judgment.

For example, in cases where the color data D1(i,j,k) to be inputted is color data for use in an NTSC signal, the luminance calculating section 41 converts the gradation data R1(i,j,k), G1(i,j,k), and B1(i,j,k) of the color data D1(i,j,k) into luminance values R1, G1, and B1, respectively, and carries out the following calculation. That is, the luminance calculating section 41 can calculate a luminance value of each pixel PIX(i,j) in accordance with $L(i,j,k)=0.3\times R1+0.59\times G1+0.11\times B1$.

Further, the average luminance Lave may be calculated from the luminances of pixels PIX(i,j) of one frame FR(k). However, in order to reduce storage capacity required of a memory, the average luminance calculating section 42 according to the preset embodiment calculates, in the following manner, an average luminance Lave that is to be compared with the luminance of a pixel PIX(i,j). That is, the average luminance Lave is calculated from the luminances of pixels PIX of one frame up to either the pixel PIX(i,j) or a pixel near the pixel PIX(i,j).

More specifically, the average luminance calculating section 42 stores the average luminance Lave, and every time new color data D1(i,j,k) of the pixel PIX(i,j) is inputted, the average luminance calculating section 42 renews the average luminance Lave in accordance with (i) the color data D1(i,j,k−1) of the previous frame and (ii) the color data D1(i,j,k) of the current frame FR(k), for example, by simultaneously subtracting the color data D1(i,j,k−1) and adding the color data D1(i,j,k). With this, when a frame memory for storing color data D1 of one frame already exists, for example, for the purpose of emphasizing a gradation transition, the average luminance Lave can be continuously calculated simply by providing the frame memory with a line memory and a delay circuit both of which cause the color data D1(i,j,k) to be delayed by time necessary for the average luminance Lave to be renewed. Therefore, as compared with an arrangement in which the average luminance Lave of all pixels PIX of the current frame FR(k) is calculated, storage capacity required of a memory can be reduced. Further, in cases where no appropriate frame memory exists, for example, the average luminance calculating means 42 may calculate the average luminance Lave1 of the color data D1 for each scanning line, and may thereby renew the average luminance Lave for every scanning of one line so that New Lave=Lave×(Number of lines−1)+Lave1. In the present embodiment, at least one line memory is used so that a small region is set to have a size larger than that of one line. Therefore, the use of the line memory makes it possible to save storage capacity.

Furthermore, see an example of how the judging section 43 according to the present embodiment gives instructions to the first and second generating sections 31 and 32. When the judging section 43 judges that the small region is a strikingly bright small region, the judging section 43 stores a modulation flag corresponding to the small region. In this example, in generating gradation data D2(i,j,k) for a pixel PIX(i,j) contained in each small region, the first and second generating sections 31 and 32 judges, in accordance with whether or not the judging section 43 stores a modulation flag corresponding to the small region, whether or not the first and second generating sections 31 and 32 output gradation data D2 (i,j,k).

According to the foregoing arrangement, for example, in cases where the video signal DAT1 indicates a display of an image, such as an entirely bright image or an entirely dark image, which does not have a strikingly bright small region, the control section 33 of the signal processing section 21 outputs the gradation data D2 generated by the second generating section 32, and each sub-pixel SPIX of the pixel array 2 is driven in accordance with the gradation data D2.

On the other hand, in case where the video signal DAT1 indicates a display of an image containing a strikingly bright small region (first small region), the signal processing section 21 causes the gradation data D2 generated by the first generating section 31 to be outputted to each pixel PIX contained in the first small region, and causes the gradation data D2 generated by the second generating section 32 to be outputted to each pixel PIX contained in another small region (second small region).

Here, in the gradation data D2 generated by the second generating section 32, the gradation data W2 to be inputted to the W sub-pixel SPIXw has been reset. On the other hand, in the gradation data D2 generated by the first generating section 31, the gradation data W2 to be inputted to the W sub-pixel SPIXw has not been reset, and has a value corresponding to the luminance of the pixel PIX.

Therefore, as compared with a case where the pixel PIX of the first small region and the pixel PIX of the second small region are driven by gradation data D2 generated by one generating section (the first or second generating section 31 or 32), the relative brightness of the first small region with respect to the brightness of the second small region can be increased. Further, even as compared with a case where a display of an image containing no strikingly bright small region is indicated, i.e., a case where all the sub-pixels SPIX are driven by the gradation data D2 generated by the second generating section 32, the relative brightness of the first small region can be increased.

As a result, in cases where the image display apparatus 1 is instructed to display an image containing a strikingly bright small region (first small region), the image display apparatus 1 can display the small region more strikingly brightly as compared with a second small region of the image and with each small region (second small region) of an image containing no strikingly bright small region, so that the image can be displayed with a high contrast ratio.

Specifically, as shown in FIG. 3 or 4, supposing that the area of the W sub-pixel SPIXw(i,j) is identical to each of the areas of the R, G, and B sub-pixels SPIXw(i,j), the area of sub-pixels SPIX to be driven (the area of R, G, and B sub-pixels) becomes ¾ as compared with an arrangement in which the pixel PIX(i,j) includes only R, G, and B sub-pixels. Therefore, as indicated by A32 of FIG. 6, in cases where the sub-pixels SPIX are driven by the gradation data D2 generated by the second generating section 32, the maximum luminance of the pixel PIX(i,j) is only approximately 75% of the maximum luminance A00 obtained when the pixel PIX(i,j) includes only R, G, and B sub-pixels.

Figure 6:
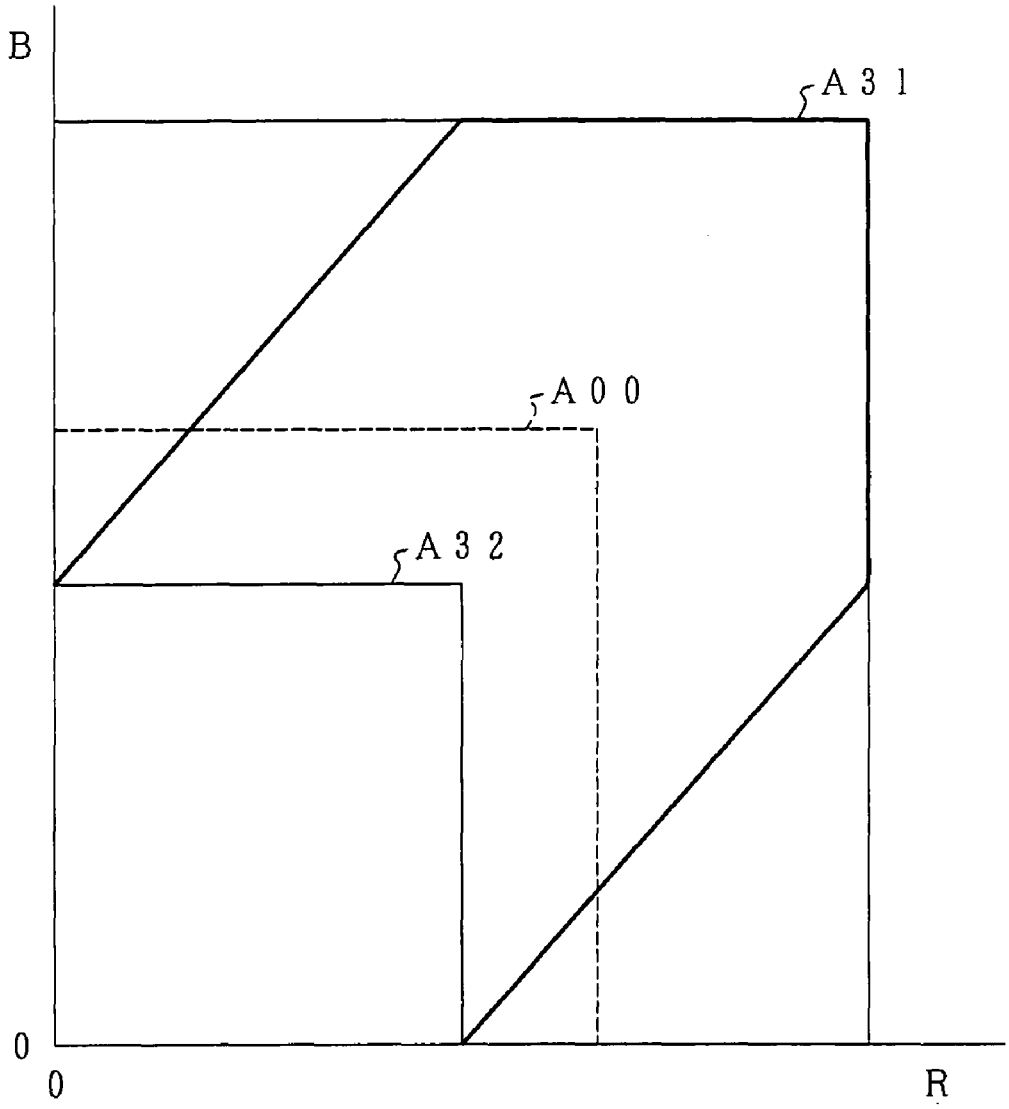
FIG. 6 is a diagram showing a range of hues and luminances that can be expressed by a pixel to be driven by first and second generating sections provided in the signal processing section.

The region A00 in FIG. 6 indicates a color reproduction range obtained when a pixel includes only R, G, and B sub-pixels. The angle between origin and axis (e.g., the angle θ between the origin and the axis R=arctan(B/R)) indicates the hue, and the distance S between the origin and the peak of the region indicates the brightness.

Meanwhile, the area of the sub-pixel SPIXw(i,j) is ¼ of the pixel PIX(i,j). However, unlike the other R, G, and B sub-pixels SPIX, the wavelength of light to be transmitted by a color filter is not limited. Therefore, in cases where the W sub-pixel SPIXw(i,j) is also driven by the gradation data D2 generated by the first generating section 31, the maximum luminance of the pixel PIX(i,j) can be 150% of the maximum luminance obtained when the pixel PIX(i,j) includes only R, G, and B sub-pixels. As a result, as indicated by A31 of FIG. 6, the luminance of the pixel PIX(i,j) can be set to be higher than in cases where the W sub-pixel SPIXw(i,j) is driven by the gradation data D2 generated by the second generating section 32.

Therefore, in cases where the image display apparatus 1 is instructed to display an image containing a strikingly bright small region (first small region), the image display apparatus 1 can display the small region more strikingly brightly as compared with a second small region of the image and with each small region (second small region) of an image containing no strikingly bright small region, so that the image can be displayed with a high contrast ratio.

Here, a shortage in peak luminance causes a user to feel that the image is less clear, less realistic, and less appealing. Meanwhile, an experiment was conducted to see to what extent the luminance of a small region needs to be higher than those of other small regions in order for the user to judge the small region to be particularly bright. As a result, it was found that a 30% to 100% improvement in luminance causes the user to regard the small region as particularly bright and pay attention to the small region. In addition, it was found that an image containing the small region is a clearer, more realistic, and more appealing image.

Therefore, by thus driving each sub-pixel SPIX of the first small region by the gradation data D2 generated by the first generating section 31 and driving the second small region by the gradation data D2 generated by the second generating section 32, the image display apparatus 1 can display, with a higher contrast ratio, an image containing a strikingly bright small region, and can display a clearer, more realistic, and more appealing image.

Further, see a case where a creator of an image intends that a display region contains a strikingly bright region and that the region is made appealing. In this case, in a video signal indicating the image, the gradation of the region is set to be strikingly brighter than those of the other regions. Therefore, by thus driving each sub-pixel SPIX of the first small region by the gradation data D2 generated by the first generating section 31 and driving the second small region by the gradation data D2 generated by the second generating section 32, the signal processing section 21 can increase the difference between (i) the luminance of the region to be made appealing and (ii) the luminance of the residual region. This allows the creator of the image to emphasize his/her intention to make the region appealing.

Note that it is in cases where a screen having a first small region judged to be strikingly bright is displayed that there is a sub-pixel SPIX to be driven by the gradation data D2 generated by the first generating section 31. When a screen having no such first small region is displayed, each sub-pixel SPIX is driven only by the gradation data D2 generated by the second generating section 32. Therefore, in cases where there is no strikingly bright small region, it is possible to prevent such a problem that display characteristics such as a color balance and a tone curve deteriorate due to the fact that a sub-pixel to be driven by the first generating means 31 and a sub-pixel to be driven by 32 are mixed in one screen. In cases where a screen containing a first small region is displayed, the user gazes at the first small region but does not gaze at a second small region for the following reason: Even when the display characteristics deteriorate due to the fact that a sub-pixel to be driven by the first generating means 31 and a sub-pixel to be driven by 32 are mixed in one screen, the first small region is a small region judged to be a strikingly bright small region. Therefore, it is possible to prevent the user from visually recognizing the aforementioned problem, thereby causing the user to feel that an image to be displayed is a clearer, more realistic, and more appealing image.

Further, when the gradation data W2 to be inputted to the W sub-pixel SPIXw is always set in accordance with the luminance of the pixel PIX, the luminance of the pixel PIX can be improved. However, this causes a big difference between gradation characteristics of neutral colors (including achromatic colors) and gradation characteristics of primary colors. This may cause an unnatural color balance. Further, in this case, the luminances of the R, G, and B sub-pixels SPIX are usually kept lower than those obtained in cases where no W sub-pixel SPIXw is provided. In other words, in this case, the R, G, and B sub-pixels SPIX are driven in a low-gradation range. Therefore, in this case, low color resolution may be caused. These may cause deterioration in overall image quality.

On the other hand, according to the foregoing arrangement, in cases where an image containing no strikingly bright small region is displayed, only the R, G, and B sub-pixels SPIX are driven and the gradation data W2 to be inputted to the W sub-pixel SPIXw is reset. This makes it possible to prevent deterioration in the overall image quality.

Note that, even in this case, most of the liquid crystal display apparatuses for use in common televisions has a luminance of 400 (nit=cd/m$^2$) or higher, and quite a few of them have a luminance of several hundred cd/m$^2$ or higher. Therefore, even as compared with a common CRT display, a shortage in luminance is rarely felt in cases where a normal picture or a solid image is displayed. Therefore, an image can be displayed without problems even when the pixel array 2 is driven by the gradation data D2 generated by the second generating section 32.

Here, when the size of a small region is too big, the number of pixels contained in the small region is becomes large. This not only complicates a judgment, but also causes such a problem that the occurrence of block separation causes deterioration in display quality. The block separation is a phenomenon in which a lengthening of a border between small regions causes the border between the small regions to be easily noticeable as a change in luminance due to a difference in driving method between the first and second small regions (difference in method of producing gradation data D2).

On the other hand, when the size of a small region is too small, the small region is misjudged more frequently as a first small region although the small region is not supposed to be displayed strikingly brightly. Further, in cases where the total area of first small regions connected to one another is small, e.g., in cases when the first regions are surrounded by a second region, the user may become unable to clearly differentiate between the first regions and the second region adjacent to them. In this case, the first small regions are not regarded as strikingly bright, so that the display characteristics (e.g., a color balance and a tone curve) of the entire region containing the first small regions are regarded as deviating from the normal characteristics. This causes deterioration in image quality.

The following more fully explains the lower limit of the size of a small region. In cases where each pixel of the pixels array 2 includes sub-pixels respectively having a plurality of colors, the sense of sight of a human being looking at the pixel array 2 is such that he/she identifies a hue not only by looking at one pixel PIX but also by looking at pixels PIX adjacent to the pixel PIX. In other words, when the user identifies a hue of each pixel constituting an image, a designer of the pixel array 2 cannot force the user to decide (i) which of the pixels adjacent to the pixel is considered in identifying the hue or (ii) which of the sub-pixels contained in the pixel are combined to form one pixel. Therefore, when the size of a small region is below 2×2 pixels, each pixel contained in the small region may be mistakenly recognized as a pixel having a color balance different from the intended color balance. For this reason, the size of a small region needs to be 2×2 pixels or more, preferably 4×4 pixels or more. With this, the influence of the peripheral pixels is eliminated, so that pixels contained in the small region is recognized as a group of pixels having a color balance intended as a color balance of the entire small region. This makes it possible to correctly convey the original intention of an image.

In the present embodiment, it is particularly preferable that the size of a small region be 1/64 or smaller than the total area of the display screen of the pixel array 2. In cases where the image display apparatus 1 has the number of pixels (640×480 pixels) as specified by VGA (Video Graphics Array), the small region has 80×60 pixels.

When the size of a small region is thus set to be 1/64 or smaller than the total area, it is possible to prevent the aforementioned judgment from being complicated and prevent the aforementioned block separation from occurring. Moreover, it is possible to cause the user to regard each first small region as strikingly bright without giving the user such an impression that the first small region is far from the entire gradation. In the present embodiment, the size of a small region is more preferably set to be in the range of 8×8 pixels to 24×24 pixels.

Incidentally, the above description shows an example of how the first generating section 31 generates gradation data D2(i,j,k). In this example, the gradation data R2(i,j,k), G2(i,j,k), and B2(i,j,k) to be inputted to the R, G, and B sub-pixels SPIX are set to have values equal to those of the gradation data R1(i,j,k), R1(i,j,k), and B1(i,j,k)) contained in the color data D1(i,j,k), respectively, and the gradation data W2(i,j,k) to be inputted to the W sub-pixel SPIXw(i,j) is set to have a value indicating the luminance of the pixel PIX(i,j). However, the present invention is not limited to this. For example, as shown in FIG. 7, the γ characteristic S31 of the gradation data D2 generated by the first generating section 31 may be set to have a γ value greater than that of the γ characteristic S32 of the gradation data D2 generated by the second generating section 32.

Figure 7:
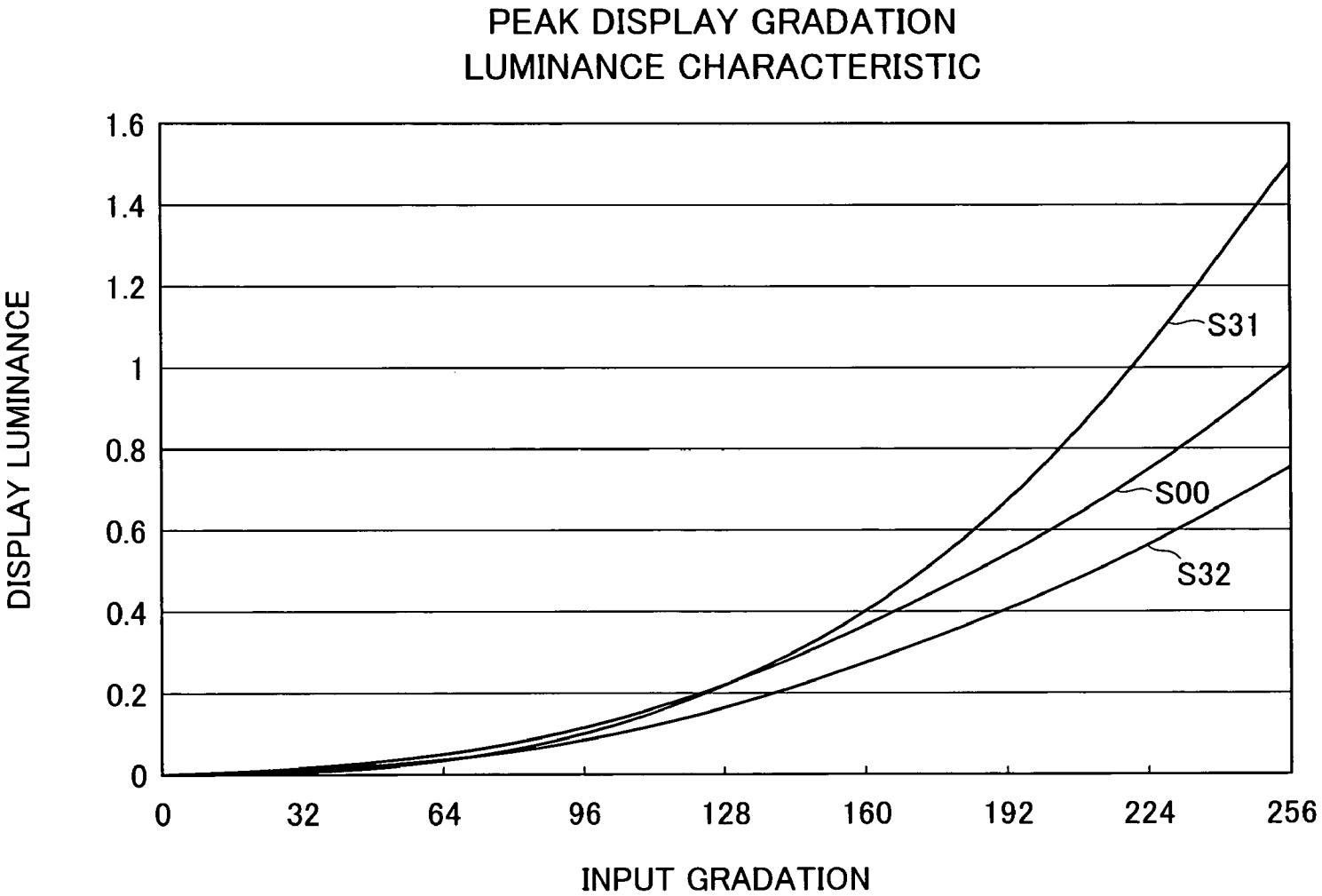
FIG. 7 shows another example of how the signal processing section is arranged, and is a diagram showing $\gamma$ characteristics of gradation data generated by the first and second generating sections, respectively.

More specifically, see FIG. 7. According to the second generating section 32, as with the arrangement described above, the gradation data R2(i,j,k), G2(i,j,k), and B2(i,j,k) to be inputted to the R, G, and B sub-pixels SPIX are set to have values equal to those of the gradation data R1(i,j,k), R1(i,j,k), and B1(i,j,k)) contained in the color data D1(i,j,k), respectively, and the γ characteristic of the color data D1(i,j,k) is identical to the γ characteristic of the gradation data D2(i,j,k) generated by the second generating section 32. According to this arrangement, supposing that the area of the W sub-pixel SPIXw(i,j) is identical to each of the areas of the R, G, and B sub-pixels SPIXw(i,j) as shown in FIG. 3 or 4, in cases where the sub-pixels SPIX are driven by the gradation data D2 generated by the second generating section 32, the maximum luminance of the pixel PIX (i,j) is only approximately 75% as compared with an arrangement in which the pixel PIX(i,j) includes only R, G, and B sub-pixels SPIX.

On the other hand, the γ characteristic of the gradation data D2(i,j,k) generated by the first generating section 31 is set to be greater than the γ characteristic of the gradation data D2(i,j,k) generated by the second generating section 32, and the maximum luminance is set to be approximately 150% of the maximum luminance obtained when the pixel PIX includes only R, G, and B sub-pixels SPIX (the γ characteristic S00). Therefore, the luminance of the pixel PIX(i,j) in the first region can be set to change more rapidly as compared with an arrangement in which the gradation data R2(i,j,k), G2(i,j,k), and B2(i,j,k) to be inputted to the R, G, and B sub-pixels are set to be identical to the gradation data R1(i,j,k), G2(i,j,k), and B2(i,j,k) of the color data D1(i,j,k), respectively. This allows the first small region to appear clearer.

Embodiment 2

Figure 1:
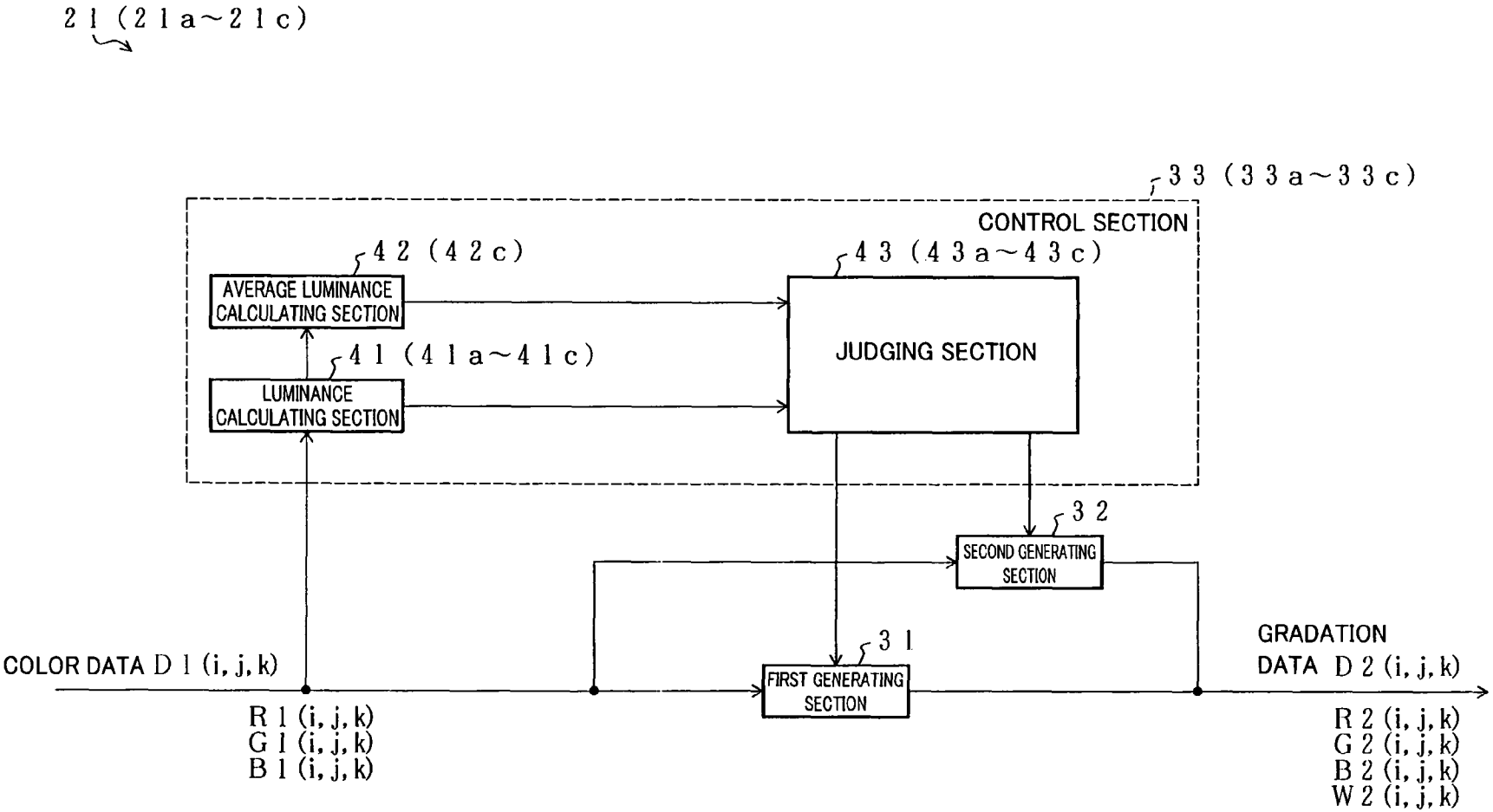
FIG. 1 shows an embodiment of the present invention, and is a block diagram showing an arrangement of a main portion of a signal processing section of an image display apparatus.

The present embodiment explains another method for judging the first small region. According to this method, the first region is judged with reference to (i) a standard deviation and (ii) the absolute value of the luminance of a pixel. That is, as shown in FIG. 1, a signal processing section 21*a* according to the present embodiment is different from Embodiment 1 in terms of a method for judging the first small region, and a judging section 43*a* is provided instead of the judging section 43.

The judging section 43 judges, as a high-luminance pixel, a pixel PIX having a luminance that is higher than the average luminance Lave of the display screen by not less than a predetermined level. On the other hand, the judging section 43*a* judges, as a high-luminance pixel, such a pixel that L(i,j,k)>Lave +α×δ is satisfied (where L(i,j,k) is the luminance of the pixel PIX(i,j), δ is the standard deviation in luminance of the display screen, and α is a predetermined constant) and that the luminance L(i,j,k) exceeds a predetermined luminance β.

In addition, the judging section 43*a* evaluates the proportion of such high-luminance pixels in each small region. Note that a preferable value of α, a preferable range of α, a preferable value of β, and a preferable range of β will be described later.

Here, as with Embodiment 1, in cases where only the average luminance Lave serves as a target of comparison, it is difficult to set the threshold value (the predetermined level used at the time of judging the luminance) to be a value appropriate for displaying any one of the various types of image. Specifically, see a case where the threshold value is set too high. In this case, for example, when an almost monotone image containing a slightly bright small region is displayed, the small region cannot be judged as a first small region, so that the peak luminance of the small region cannot be improved. On the other hand, see a case where the threshold value is set too low. In this case, when an image, such as an ordinary image (e.g., a television broadcast or a motion picture), which has relatively wide variations in luminance of the display screen, it is judges that the display screen always has a large number of first small regions. In this case, the influence of a process for strikingly bright small regions is greatly reflected in the normal display characteristics, so that display characteristics such as a color balance and a tone curve may deviate from the desired characteristics.

On the other hand, in a control section 33*a* according to the present embodiment, the judging section 43*a* makes a judgment with reference to the standard deviation. As the standard deviation becomes smaller, the luminance of each pixel PIX needed for the judging section 43*a* to judge, as a first small region, a small region containing the pixel PIX is made lower. Therefore, in cases where an almost monotone image in which a slightly bright small region is contained and in which the small region is a strikingly bright small region is displayed, a small region slightly brighter than the average luminance Lave is judged as a first small region, so that the small region can be displayed brightly.

On the other hand, as compared with the case of the monotone image, in cases where an image having wide variations in luminance of the display screen is displayed, a small region having a brightness brighter than the average luminance Lave is also judged as a second small region. Therefore, it is possible to prevent such an aforementioned problem that the judgment that the display screen always has a large number of first small regions has a bad effect on a display characteristic such as a color balance or a tone curve.

As a result, as compared with the arrangement of Embodiment 1, a strikingly bright small region can be appropriately judged even in cases where more various types of image are displayed. This makes it possible to emphasize the feeling that these images are clear, realistic, and appealing.

Here, when the value of a is set too high, a pixel PIX contained in a strikingly bright small region cannot be judged as a high-luminance pixel, so that it is impossible to emphasize the feeling that an image is clear, realistic, and appealing. On the other hand, when the value of a is set too low, the aforementioned problem is caused. Therefore, in order to prevent the aforementioned problem from occurring and emphasize the feeling that an image is clear, realistic, and appealing, it is preferable that α is set to fall within a range of 1.5 to 2. In the present embodiment, α is particularly preferably set to be 2. With this, even in cases where more various types of image are displayed, a strikingly bright small region can be appropriately judged, so that it is possible to emphasize the feeling that these images are clear, realistic, and appealing.

Furthermore, the judging section 43*a* according to the present embodiment refers to the absolute value of the luminance of the pixel PIX(i,j) as well as the standard deviation, and in cases where the absolute value of the luminance of the pixel PIX(i,j) is not more than a certain value, the pixel PIX(i,j) is not judged as a high-luminance pixel. Therefore, it is possible to prevent the following problem: As a result of judging an inappropriate pixel PIX(i,j) as a high-luminance pixel due to a statistical error, a small region that cannot be said to be strikingly bright is misjudged as a first small region.

Here, when the threshold value β is too large, a pixel PIX (i,j) contained in a strikingly bright small region cannot be judged as a high-luminance pixel, so that it is impossible to emphasize the feeling that an image is clear, realistic, and appealing. On the other hand, when the threshold value β is too small, the aforementioned problem is caused.

Generally, it is unlikely for a creator of an image to provide such a setting that the luminance of an observation target to be regarded by a user as a small region having a peak luminance is set to be lower than 20% of the white luminance. Therefore, in the present embodiment, the threshold value β is a value indicating approximately 20% of the white luminance. The threshold value β may be compared on the basis of a luminance value. However, in the present embodiment, the threshold value β is compared on the basis of a gradation value indicating the luminance of the pixel PIX(i,j), and is set to be half (128 gradations, in case of 256 gradations) of the maximum gradation (white) in cases where the luminance of the pixel PIX(i,j) is expressed by a gradation having a gamma of 2.2. This makes it possible to substantially securely prevent the aforementioned problem from occurring in an ordinary image.

Embodiment 3

Incidentally, in Embodiments 1 and 2, it is judged for each pixel PIX contained in a small region as to whether or not the pixel PIX is a high-luminance pixel, and it is judged, in accordance with the proportion of high-luminance pixels contained in the small region, whether or not the small region is a first small region.

On the other hand, in the present embodiment, the pixel PIX is replaced by a small block including a plurality of pixels PIX, and it is judged whether or not the small block is a high-luminance block. Then, it is judged, in accordance with the proportion of high-luminance blocks contained in the small region, whether or not the small region is a first small region. The arrangement can be applied to any one of Embodiments 1 and 2. However, the following explains a case where the arrangement is applied to Embodiment 2.

That is, a signal processing section 21*b* according to the present embodiment is different from Embodiment 2 in terms of a unit by which a luminance is calculated, a luminance calculating section 41*b* provided instead of the luminance calculating section 41 calculates, in accordance with the video signal DAT1, the average luminance of each small block contained in each small region. Accordingly, a judging section 43*b* according to the present embodiment judges, in accordance with (i) the average luminance of each small block as calculated by the luminance calculating section 41*b* and (ii) the average luminance Lave calculated by the average-luminance calculating section 42, whether the small block is a high-luminance block, instead of making a judgment for each pixel PIX as to whether or not the pixel PIX is a high-luminance pixel. Except that, the judging section 43*b* judges, in the same manner as the judging section 43*b* does, whether or not a small region is a first small region.

Specifically, the judging section 43*b* judges, as a high-luminance block, such pixels that $L>Lave+\alpha\times\delta$ is satisfied (where L is the luminance of the small block as calculated by the luminance calculating section 41, δ is the standard deviation in luminance of the display screen, and α is a predetermined constant) and that L exceeds a predetermined luminance β. Furthermore, the judging section 43*b* judges, in accordance with whether or nor the proportion of high-luminance blocks contained in a small region is not less than a predetermined proportion, whether or not the small region is a first small region.

According to the foregoing arrangement, the control section 33*b* does not make a judgment for each pixel PIX as to whether the pixel PIX is a high-luminance pixel, but makes a judgment for each small block including a plurality of pixels PIX as to whether or not the small block is a high-luminance block. This makes it possible to reduce the amount of data and calculation needed for a statistical analysis process, so that the size of circuit can be reduced.

Especially, the statistical analysis process (the process of calculating the in-plane average luminance and the process of calculating the standard deviation) of Embodiment 2 is more complicating than the statistical analysis process (the process of calculating the in-plane average luminance) of Embodiment 1. The aforementioned arrangement brings about a greater effect, i.e., reduces the amount of data and calculation more greatly when it is applied to Embodiment 2 than Embodiment 1.

When the size of the small block is too small, the amount of data and calculation cannot be reduced sufficiently. On the other hand, when the size of the small block is too big, the small block may not be judged as a high-luminance block although the small block contains a pixel that can be recognized by the user's eyes as a high-luminance pixel. This is because the average of the luminance of the pixel PIX and the luminance of a pixel PIX adjacent to the pixel PIX is taken. In this case, the judging section 43*b* misjudges a strikingly bright small region as a second small region. This may cause a problem that image quality deteriorates.

Therefore, the size of the small block is preferably set so that a result of a judgment made in the following conditions (1) to (3) ((1) the average luminance value represents the luminance of each pixel, (2) it is judged, in accordance with the average luminance value, whether or not the small block is a high-luminance small block, and (3) it is judged, in accordance with the proportion of small blocks contained in a small region, whether or not the small region is a first small region) is not much different from a result of a judgment made by the user's sense and a result of a judgment made for each pixel.

The unit of 8×8 pixels is a unit used as a unit block for use in a correlation judgment or the like in an image compression technique standardized, for example, by MPEG (Moving Picture Experts Group) or JPEG (Joint Photographic Experts Group). Even if the small block is set to have this size, the aforementioned problem is not caused.

Embodiment 4

Incidentally, in each of Embodiments 1 to 3, the luminance value of a pixel PIX is calculated from each piece of gradation data contained in color data D1 of the pixel PIX, and the calculation of the average luminance Lave and the judgment as to whether or not the pixel PIX is a high-luminance pixel (or whether or not the small block is a high-luminance block) are made in accordance with the luminance value.

On the other hand, in the present embodiment, the value of gradation data is not converted into a luminance value, and it is judged, in accordance with the value of gradation data, whether or not a pixel PIX is a high-luminance pixel (or whether or not a small block is a high-luminance block) and whether or not a small region is a first small region. The arrangement can be applied to any one of Embodiments 1 to 3. However, the following explains a case where the arrangement is applied to Embodiment 3.

That is, a signal processing section 21*c* according to the present embodiment is different from Embodiments 1 to 3 in that it judges, not on the basis of a luminance value but on the basis of a gradation value, whether or not a small region is a first small region. A luminance calculating section 41*c* provided instead of the luminance calculating section 41*b* calculates, in accordance with the video signal DAT1 and on the basis of a gradation value, the average luminance of each small block contained in each small region. Similarly, an average-luminance calculating section 42*c* provided instead of the average-luminance calculating section 42 calculates the average luminance of the display screen in accordance with the video signal DAT1 and on the basis of a gradation value. Accordingly, a judging section 43*c* according to the present embodiment judges, in accordance with (i) the average luminance of each small block as calculated on the basis of a gradation value by the luminance calculating section 41*c* and (ii) the average luminance Lave calculated on the basis of a gradation value by the average luminance calculating section 42 and on the basis of a gradation value, whether or not the small region is a first small region.

Specifically, in cases where the average luminance is directly calculated on the basis of a gradation value, the average luminance is underestimated. Therefore, a member (the luminance calculating section 41*c* and the average-luminance calculating section 42*c* in this case) for calculating the average luminance adds, to the average gradation value, a value calculated in a predetermined procedure.

More specifically, for example, in cases where the γ value falls within a range of approximately 2 to 3, the addition of a value ½ to 1 times the standard deviation makes it possible to calculate the average value with sufficient accuracy. Therefore, the member (41*c* and 42) according to the present embodiment calculates the average luminance in accordance with the following formula: Average Luminance (on the basis of a gradation value)=Average Gradation Value+0.5×Standard Deviation in Gradation. Further, for example, the judging section 43*c* employs, as a predetermined level, either a level twice as high as the average luminance or a level calculated by Average Luminance+Standard Deviation in Gradation=Average Gradation Value+3/2×Standard Deviation in Gradation.

Strictly speaking, for example, a calculation on the basis of a gradation value cannot make it possible to accurately find (i) the average luminance of the entire display screen (display area), (ii) the average luminance of each small block or the standard deviation, and (iii) the like. However, a control section 33*c* according to the present embodiment distinguishes between (a) a comparatively dark region having a large area and (b) a comparatively sufficiently bright region having a small region. In the former case, the second generating section 32 is caused to generate gradation data. In the latter case, the first generating section 31 is caused to generate gradation data. Therefore, even when a calculation is made on the basis of a gradation value, the relative brightness of each small region can be calculated with sufficiently practical accuracy, and it can be judged whether or not the small region is a first small region.

According to this arrangement, the control section 33*c* judges, not on the basis of a luminance value but on the basis of a gradation value, whether or not the small region is a first small region. Therefore, as compared with the arrangement in which a judgment is made after the color data D1(i,j,k) inputted as gradation data is converted into luminance, a calculation of a luminance value can be omitted, so that (i) the amount of calculation needed for judging whether or not the small region is a first small region and (ii) the size of circuit needed for the calculation can be reduced.

For example, suppose that a luminance is expressed as a gradation having a gamma of 2.2. Then, in cases where a gradation value of a pixel PIX is twice as large as a gradation value of another pixel PIX, the former pixel PIX has a luminance value approximately 5 times as large as that of the latter pixel PIX on the basis of a luminance value. Therefore, by judging whether or not the average value of gradation data of each pixel PIX(i,j) or the average value of gradation data of a pixel PIX(i,j) contained in a small block is twice as large as or larger than the average luminance Lave, it can be judged whether or not the average value is 5 times as large as or larger than the average luminance Lave. Thus, it can be judged whether or not the small region is a first small region.

According to Embodiments 1 and 2, it is judged, in accordance with the proportion of high-luminance pixels contained in a small region, whether or not the small region is strikingly bright (a first small region). According to Embodiment 1, a judgment as to whether or not a pixel is a high luminance pixel is made by comparing the luminance of the pixel with the average luminance of the entire screen. Further, according to Embodiment 2, as the standard deviation of the whole screen becomes smaller, the luminance which each pixel needs to have so as to be judged as a high-luminance pixel is made lower.

Furthermore, according to Embodiment 3, instead of making a comparison for each pixel, a judgment is made in accordance with whether or not a small block contained in a small region is a high-luminance block. According to Embodiment 4, it is judged, not in accordance with a luminance value but in accordance with gradation data, whether or not a pixel is a high-luminance pixel (or whether or not a small block is a high-luminance block).

Thus, according to each of the embodiments, the brightness of a small region is relatively evaluated with reference to the brightness of the entire display screen. However, the present invention is not limited to this.

For example, in cases where both a moving-image region and a still-image region are contained in a display screen, e.g., in cases where a moving image is displayed on a screen of a computer or where a button is displayed on a screen of a television receiver, the brightness of a small region may be relatively evaluated with reference to the brightness of the entire moving-image region on the assumption that only the moving-image region is a display screen.

Similarly, see a case where the image display apparatus (1 to 1*c*) serves as a monitor apparatus for displaying a screen of a computer. In this case, there is no correlation in image between an active window and a region other than the active window, and it is undesirable that an image displayed by the active window is changed in accordance with an image displayed by the region other than the active window. Also in this case, the brightness of a small region contained in the active window may be relatively evaluated with reference to the brightness of the entire active window on the assumption that the active window is a display region.

The signal processing section pins down the moving-image region and the active window, for example, by receiving a notification from another section of the display system (e.g., from a system such as an OS).

Further, instead of referring to the entire display screen or the entire moving-image region, it is possible to refer to the brightness of a region which is not as large as such entire regions but which is large enough to be judged by an observer as representative of the impression of an image to be displayed in such entire regions. Examples of such a region include a region, surrounding a point of observation, which covers the observer's field of vision. The region serving as a target of comparison may contain a small region serving as a target of judgment, and may be a region, excluding the small region serving as a target of judgment, which is adjacent to the small region. Examples of such a region include a region disposed so as to surround a target of judgment.

Specifically, the signal processing section (21*a* to 21*c*) or, more specifically, the control section (33 to 33*c*) may set, as the region to be referred to (region serving as a target of comparison), a region whose examples include Regions 1 to 4. Region 1 is a region, located in a central portion of the display screen, which has a predetermined size. Region 2 is a region seen in a predetermined viewing-angle range. Region 3 is a region having a predetermined area ratio with respect to the entire display screen. Region 4 is a region, surrounding the first zone (small region), which has a predetermined size relative to the first zone.

First, the following explains Region 1. In many cases, the image maker dispose, in the central portion of the display screen, an image which he/she wants to be appealing, and the viewer often gazes at the central portion of the display screen. Therefore, a central region set to have a size described below can be suitably used as a region that is to be judged by the observer as representative of the impression of an image to be displayed on the entire display screen.

That is, when the lengthwise size (length) of the region serving as a target of comparison is below 20% of that of the display region, the region is visually recognized as having been specially disposed. Therefore, the lengthwise size (length) of the region preferably falls within a range of 20% to 100% of that of the display region. Furthermore, when the lengthwise size of the region serving as a target of comparison is not less than 33% (not less than ⅓) of that of the display region, it is easy to intuitively recognize the region as a central region. Therefore, the lengthwise size of the region may be more preferably set to be not less than 33% of that of the display region. Further, when the lengthwise size of the region serving as a target of comparison exceeds 50% of that of the display region, the region is easily judged as a majority in terms of the area of the region. Therefore, the lengthwise size of the region is still more preferably set to be larger than 50% of that of the display region.

Similarly, it is basically preferable that the crosswise size (length) of the region serving as a target of comparison be in a range of 20% to 100% of that of the display region, more preferably not less than 33% of the of the display region, and still more preferably larger than 50% of that of the display region.

Furthermore, in case of a large wide-screen television, the lower limit of each of the aforementioned ranges of numerical values can be preferably set to be ¾ (75%). Specifically, a large wide-screen television (having an aspect ratio of 16:9) can enlarge and display a transversely-elongated portion of an image for use in a television having a standard aspect ratio (aspect ratio of 3:4), thereby providing the feeling of presence. Thus, in case of a large wide-screen television, when the crosswise size of a region exceeds ⅔ (133%) of the lengthwise size of the display screen, i.e., when the crosswise size of the region exceeds ¾ (75%) of the crosswise size of the display screen, the viewer judges the region substantially as a whole. Therefore, in case of a wide-screen television, the crosswise length of the region serving as a target of comparison is preferably set to be in a range of 15% to 100% of that of the display screen, more preferably 25% to 100% of that of the display screen, and still more preferably 50% to 100% of that of the display screen.

Further, in cases where Region 1 serves as a target of comparison, a region to be referred to (region to be calculated) is fixed and the area thereof is limited regardless of which of the ranges of numerical values is set. Therefore, in cases where the signal processing section sets Region 1 as a region serving as a target of comparison, the amount of calculation can be made comparatively small and the signal processing section can be comparatively easily mounted.

According to the above description, the region serving as a target of comparison is set in terms of the ratio of the region to the entire display screen. However, see a case of a display to be used for a purpose that is based on the premise that its display screen covers most of the viewer's viewing angle. Examples of such a display include (i) an emergency large information display and (ii) a high-resolution information display to be used with its display device gazed closely at. In such a case, the region serving as a target of comparison can be suitably set in terms of a range of viewing angles. For example, instead of Region 1, Region 2 can be set as a region serving as a target of comparison. Specifically, when the viewer looks at the display screen from a position assumed when the display is used for that purpose, it is preferable that the viewing angle in a right-and-left direction be set to fall within a range of 15° to 360°, more preferably 25° to 360°. Further, it is preferable that the viewing angle in an up-and-down direction be set to fall within a range of 10° to 360°, more preferably 20° to 360°.

When the region serving as a target of comparison is set to fall within the aforementioned range, the viewer recognizes that the region occupies most of his/her field of view with him/her gazing at the display screen, and that the region is a region to be mainly observed. Therefore, by setting the region as a target of comparison, it is possible to make an accurate judgment for each first zone (small region) as to whether or not the first zone is strikingly bright, so that the first zone can be displayed more strikingly brightly in cases where the first zone is judged to be strikingly bright.

The above description explains an example in which the location of a region serving as a target of comparison is fixed regardless of the location of a first zone (small region). However, as with Regions 3 and 4, the signal processing section may change, in accordance with the location of a first zone (small region), the location of a region serving as a target of comparison.

Specifically, the signal processing section may set, as a region serving a target of comparison, Region 3 which has been located in accordance with the coordinates of a first zone. In this case, in order for the region to be regarded as sufficiently large with respect to the first zone, it is preferable that the area of the region serving as a target of comparison be set to fall within a range of at least 15% to 100% of that of the entire display screen, more preferably 25% to 100% of that of the entire display screen.

The signal processing section may set the region to have a rectangular or square shape. Further, when the region serving as a target of comparison is set to be in a location corresponding to the coordinates of the first zone, the signal processing section may provide such a setting that the first zone (small region) is disposed in a central 25% portion of the region. Furthermore, more preferably, the signal processing section provides such a setting that regions serving as a target of comparison overlap one another and that a first zone (small region) is disposed in a central 25% portion of each of the regions. According to this arrangement, a judgment in consideration of a balance between parts and the whole can be made while the amount of calculation becomes comparatively larger. This makes it possible to make an accurate judgment for each first zone (small region) as to whether or not the first zone is strikingly bright, so that the first zone is displayed more strikingly brightly in cases where the first zone is judged to be strikingly bright. An arrangement in which the aforementioned setting method is employed can be suitably used especially for a large-screen high-definition television.

Further, according to the signal processing section, in cases where Region 4 is set as a region serving as a target of comparison, the region may be at least set to have a size three times or larger than that of the first zone, more preferably five times or larger than that of the first zone, still more preferably ten times or larger than that of the first zone. This makes it possible to prevent such a phenomenon that, instead of the first zone being judged as a strikingly bright region, the second zone is judged as a minor region whose luminance has been reduced. This makes it possible cause the viewer to judge the first zone as a strikingly bright region.

Further, also in cases where the signal processing section sets Region 4 as a region serving as a target of comparison, the area of a region to be referred to (region to be calculated) is limited, so that the amount of calculation can be made comparatively small and that the signal processing section can be comparatively easily mounted. Further, this arrangement can be suitably applied to a monitor whose screen is comparatively easily gazed at as compared with a television.

Furthermore, the signal processing section sets any one of Regions 1 to 4 as a region serving as a target of comparison. On this occasion, a parameter (the size of the region serving as a target of comparison) may be fixed. However, the parameter may be changed in accordance with a condition. Examples of the condition include (1) a condition as to whether the image display apparatus serves a television or a monitor apparatus of a computer, (2) the size of the display screen (a condition as to how much of the viewing angle is occupied), and (3) the white luminance of a display carried out by the image display apparatus. Further, for example, see a case where parameters such as sharpness and contrast are incorporated as adjustable parameters into an image menu so that the viewer can input his/her desired sharpness and contrast. In this case, in accordance with the viewer's input, the signal processing section may set any one of Regions 1 to 4 as a region serving as a target of comparison. Alternatively, on this occasion, the parameter (the size of the region serving as a target of comparison) may be changed.

In any case, the same effects are obtained provided that the region serving as a target of comparison has a luminance approximately representative of the luminance of the entire display region. More specifically, when the judging section makes a judgment for each small region as to whether or not the small region is a first small region, the judging section may make a judgment as described below, instead of relatively evaluating, as described above, the brightness of each small region with reference to the brightness of the entire display screen. That is, the judging section may (i) divide the display region into a plurality of small regions, (ii) make a judgment for each of the small regions as to whether or not the small region is a first small region, (iii) define, in the display region, the comparison target region sufficiently lager than the small region serving as a target of judgment, and (iv)

judge, with reference to the brightness of the comparison target region, whether or not the small region is a first small region.

Even when the judging section is arranged in such a manner, a signal processing section including the judging section can divide a display region into a plurality of small regions and control a gradation luminance characteristic of each of the small regions, as with each of the signal processing sections (21 . . . ) described above. Further, see a case where the display region includes (i) a first zone which contains at least one of the small regions and (ii) a second zone which is larger than the first zone and where a video signal for causing the first zone to display white and for causing the second zone to display a preset second-zone gradation is supplied. In this case, the luminance of the first zone is referred to as "first-zone white gradation luminance". Then, the signal processing section can control the gradation luminance characteristic of each of the small regions so that the first-zone white gradation luminance obtained when the second-zone gradation indicates a gradation (e.g., a black gradation) lower than a predetermined gradation is higher than that obtained when the second-zone gradation indicates white.

Thus, each of the signal processing sections drives a display apparatus in the following manner. That is, the signal processing section divides a display region into a plurality of small regions, and carries out a conversion of a γ (gradation luminance characteristic) for each of the small regions in accordance with a video signal. The display region is set to have a comparatively small first zone which contains at least one small region and a comparatively large second zone, and the first and second zones are supplied with display gradations independently of each other so that the luminance corresponding to a white gradation of the small region contained in the first zone becomes higher depending on the display luminance of the second zone.

Therefore, in cases where a display of an image containing a strikingly bright small region (first small region) is indicated, the small region can be displayed more strikingly brightly than (i) the other regions of the image and (ii) each small region of an image containing no strikingly bright small region, so that the image can be displayed with a high contrast ratio. This allows the display screen of the display apparatus to display a clearer, more realistic, and more appealing image.

The signal processing section may at least start such a control operation that the first-zone white gradation luminance is increased when the second-zone gradation indicates a black display. However, as described in each of the embodiments, it is preferable that the control operation be started when a gradation lower than a predetermined gradation is indicated. For example, according to Embodiment 1, in cases where a small region indicates white and the other regions indicate a gradation lower than a gradation set to be approximately 0.5 times as high as the white gradation on a gradation-value basis of a γ value of 2.2, the pixels of the small region are driven by the video data generated by the first generating section 31.

Thus, the control operation is started when the gradation lower than the predetermined gradation is indicated. With this, when the white luminance of the first zone is higher than the luminance of the second zone by a certain degree or higher, the white luminance of the first zone can be made even higher, so that the first zone can be displayed more clearly.

Further, as described above, the signal processing section determines, in accordance with whether a small region is a first small region, whether the gradation data D2(i,j,k) generated by the first generating section 31 or the gradation data D2(i,j,k) generated by the second generating section 32 is outputted as gradation data D2(i,j,k) for a pixel PIX(i,j) contained in the small region. Therefore, when a display is carried out in a region other than the first small region, the second generating section 32 can control a gradation luminance characteristic of the region so that a γ characteristic having a predetermined first γ value is obtained. The first generating section 31 can control a gradation luminance characteristic of the first small region so that a γ characteristic having a predetermined second γ value not smaller than the first γ value is obtained.

Thus, while the signal processing section is receiving a video signal for causing the entire display region to display gradations identical to one another, the signal processing section controls the respective gradation luminance characteristics of the first and second zones so that the γ characteristic having the predetermined first γ value is obtained. In addition, when the second-zone gradation indicates a gradation lower than the predetermined gradation, the signal processing section controls the gradation luminance characteristic of the first zone so that the γ characteristic having the second γ value not smaller than the first γ value is obtained.

This not only allows the first small region (first zone) to be entirely bright, but also makes it possible to increase, with respect to a gradation indicating a certain luminance or higher, the rate at which the luminance changes when the gradation is changed. With this, the brightness of a bright portion of the first zone can be emphasized, and the darkness of a dark portion of the first zone can be emphasized. This makes it possible to make sharp differences among pixels within the first zone. As a result, an image to be displayed in the first small region can be emphasized, so that a clearer image can be expressed.

Further, as described above, each of the signal processing sections recognizes the first zone (first small region) as a bright place even if not all pixels contained in the first zone are set to have a certain luminance or higher, provided that the first zone contains bright pixels with a certain ratio or higher. Then, the signal processing section drives, in accordance with the video data generated by the first generating section, the pixels contained in the zone (small region). Therefore, the driving can be carried out so that the pixels contained in the zone (small region) have γ characteristics having γ values identical to one another. This makes it possible to prevent a problem that occurs in cases where there is a mixture of pixels driven with γ characteristics having different γ values. That is, this makes it possible to prevent deterioration in display characteristics such as a color balance and a tone curve.

Each of the embodiments explains a case where members constituting the signal processing section (21 to 21*c*) are realized by using hardware alone. However, the present invention is not limited to this. All or part of the members may be realized by using a combination of (i) a program for realizing the aforementioned functions and (ii) hardware (a computer) for executing the program. For example, the signal processing section may be realized such that a computer connected to the image display apparatus (1 to 1*c*) serves as a device driver to be used in driving the image display apparatus. Further, see a case where the signal processing section is realized as a conversion substrate that is to be built in or externally attached to the image display apparatus and a rewriting of a program such as firmware allows for change in operation of a circuit that realizes the signal processing section. In this case, the hardware may be operated as the signal processing section of each of the embodiments by (a) distributing the software by distributing a recording medium storing the software or by transmitting the software via a communication path, and by (b) causing the hardware to execute the software.

In these cases, as long as hardware capable of executing the aforementioned functions is prepared, the signal processing section according to each of the embodiments can be realized only by causing the hardware to execute the program.

More specifically, the signal processing section according to each of the embodiments is realized by using software in the following manner. That is, calculating means including a CPU or hardware capable of executing the aforementioned functions executes a program code stored in a storage device such as a ROM or a RAM, and controls peripheral circuits such as input-output circuits (not shown).

In this case, the signal processing section can be realized by using a combination of (i) hardware for performing part of processing and (ii) the calculating means for controlling the hardware and for executing the program code for performing the rest of the processing. Furthermore, among the members, even a member explained as hardware can be realized by using a combination of (i) hardware for performing part of processing and (ii) the calculating means for controlling the hardware and for executing the program code for performing the rest of the processing. Further, the calculating means may be made up of a single processor or the like. Alternatively, the calculating means may be made up of a plurality of processors or the like that are so connected to one another via buses or channels inside the apparatus as to execute the program code together.

A program such as (i) the program code which can be executed directly by the calculating means or (ii) a program that is data from which the program code can be generated by carrying out a process such as decompression (will be described later) is (a) distributed by storing this program (the program code or the data) in a storage medium, or (b) distributed by transmitting the program using communication means for transmitting the program via a wired or wireless communication path. Then the program is executed by the calculating means.

In the case of transmitting the program via the communication path, a signal string indicating the program is transmitted via transmission media constituting the communication path, that is, the signal string is transmitted from one transmission medium to another. In this way, the program is transmitted via the communication path. Further, when transmitting the signal string indicating the program, the signal string may be superimposed on a carrier wave by causing the transmitting apparatus to modulate the carrier wave with the use of the signal string. In this case, the receiving apparatus demodulates the carrier wave so as to restore the signal string. On the other hand, when transmitting the signal string, the transmitting apparatus may (i) divide the signal string that is a digital data string into packets and (ii) transmit the packets. In this case, the receiving apparatus links received packets with each other so as to restore the signal string. Further, when transmitting the signal string, the transmitting apparatus may (i) combine the signal string with another signal string using a method such as time division, frequency division, or code division, and (ii) transmit the combined signal string. In this case, the receiving apparatus extracts the individual signal strings from the combined signal string so as to restore the signal strings. In either case, the same effect can be obtained as long as the program is transmitted via the communication path.

Here, the storage medium used for distributing the program is preferably detachable. However, a storage medium used for storing the distributed program may or may not be detachable. Further, as long as the storage medium stores the program, the storage medium may or may not be rewritable (writable) or volatile. Furthermore, the storage medium may store the program in any manner, and may have any shape. Examples of the storage medium are: (i) tapes such as a magnetic tape and a cassette tape; (ii) magnetic disks such as a Floppy® disk and a hard disk; (iii) disks such as a CD-ROM, a magnetic optical disk (MO), a mini disk (MD), and a digital video disk (DVD); (iv) cards such as an IC card and an optical card; (v) semiconductor memories such as a mask ROM, an EPROM, an EEPROM, and a flash ROM; and (vi) a memory provided in calculating means such as a CPU.

The program code may be a code for instructing the calculating means to carry out all steps of each of the foregoing processes. Alternatively, if there already exists a basic program (e.g., an operating system or a library) which can be started up in a predetermined manner and execute all or part of the steps, all or part of the steps may be substituted with the use of a code or pointer for instructing the calculating means to start up the basic program.

In addition, the program storage format of the storage medium may be, for example, such that: the calculating means can access the program for an execution as in an actual memory having loaded the program; the program is not loaded into an actual memory, but installed in a local storage medium (for example, an actual memory or hard disk) always accessible to the calculating means; or the program is stored before installing in a local storage medium from a network or a mobile storage medium. In addition, the program is not limited to compiled object code. The program may be stored as source code or intermediate code generated in the course of interpretation or compilation. In any case, the similar effects are obtained regardless of the format in which the storage medium stores the program, provided that decompression of compressed information, decoding of encoded information, interpretation, compilation, links, or loading to a memory or combinations of these processes can convert into a format executable by the calculating means.

Further, each of the embodiments explains a case where the video signal source VS transmits color data D1 corresponding to one frame and then transmits color data D1 corresponding the next one frame. However, the present invention is not limited to this. For example, it may be that one frame is divided into a plurality of fields (e.g., two fields) and that the video signal source VS transmits color data D1 corresponding to one field and then transmits color data D1 corresponding to the next field. Further, provided that any one of the signal processing section (21 to 21*c*), the control circuit 5, the data signal line driving circuit 3, and the pixel PIX stores color data D1 corresponding to one frame, the video signal source VS may transmit color data D1(i,j,k) only to a pixel PIX(i,j) whose display color has been changed. In either case, the same effects are obtained provided that the video signal DAT1 containing color data D1 is in a signal format capable of containing (i) information for the data signal line driving circuit 3 to indicate a display state of each sub-pixel SPIX every frame period and (ii) information for relatively comparing the brightnesses of small regions contained in the display screen.

Similarly, each of the embodiments explains a case where the signal processing section transmits gradation data D2 corresponding to one frame and then transmits gradation data D2 corresponding to the next frame. However, the signal processing section may transmit gradation data D2 to each field. Further, provided that any one of the control circuit, the data signal line driving circuit, and the pixel PIX stores color data D1 corresponding to one frame, the signal processing section may transmit gradation data D2(i,j,k) only to a pixel PIX(i,j) whose display color has been changed. In either case, the same effects are obtained provided that the video signal DAT2 containing gradation data D2 is in a signal format capable of containing information for the data signal line driving circuit to indicate a display state of each sub-pixel SPIX every frame period.

Furthermore, according to each of the embodiments, for example, in order to emphasize/limit the luminance of a sub-pixel SPIXw in accordance with whether or not a small region containing the sub-pixel SPIXw is a first small region, the signal processing section interposed between the video signal source VS and the data signal line driving circuit controls the value of gradation data W2 to be inputted to the sub-pixel SPIXw. However, the present invention is not limited to this. For example, provided that the data signal line driving circuit can emphasize/limit, in response to instructions, a driving signal to be sent to the sub-pixel SPIXw, the first and second generating sections 31 and 32 may be removed from the signal processing section and a result of judging whether or not the small region is a first small region may be indicated to the data signal line driving circuit. In either case, the same effects are obtained provided that the driving of the sub-pixel SPIXw can be emphasized/limited in accordance with whether or not the small region is a first small region. However, as with each of the embodiments, in cases where the signal processing section controls gradation data D2, the control circuit and the data signal line driving circuit do not need to be provided with a function of emphasizing/limiting the driving of the sub-pixel SPIXw in accordance with instructions. Therefore, the present invention can be applied to more control circuits and more data signal line driving circuits.

Further, the above description explains a case where the color data D1 is expressed by gradation information R1, G1, and B1 respectively corresponding to the sub-pixels SPIXr, SPIXg, and SPIXb, except for the sub-pixel SPIXw, among the sub-pixels SPIX. However, the present invention is not limited to this. For example, even in cases where the color data D1 is expressed by a non-RGB color system such as an XYZ color system, the same effects are obtained provided that gradation data R2, G2, B2, and W2 to be respectively inputted to the sub-pixels SPIXr, SPIXg, SPIXb, and SPIXw can be generated in accordance with the color data D1.

Furthermore, the above description explains a case where a homeotropic-mode and normally-black-mode liquid-crystal cell is used as a display element. However, the same effects are obtained provided that a shutter-type device is used. Further, even if a shutter-type device is not used, the same effects are obtained provided that each of a plurality of pixels constituting a display screen of a display apparatus has a plurality of sub-pixels for displaying different colors by a color of a color filter or by using or not using a color filter. However, as with each of the embodiments, a homeotropic-mode and normally-black-mode liquid-crystal cell allows for a very low black luminance and a high contrast ratio, so that an image is easily made sharper as the luminance is improved. This brings about more preferable effects.

The above description explains a case where the respective display areas of the R, G, B, and W sub-pixels SPIX are equal. However, the present invention is not limited to this. The same effects are obtained regardless of the ratio among the respective display areas of the sub-pixels SPIX and of the way the sub-pixels are arrayed.

Furthermore, the above description explains a case where each pixel PIX is provided with R, G, B, and W sub-pixels SPIX. However, the present invention is not limited to this. For example, red, blue, and purple sub-pixels SPIX may be provided. As long as a specific sub-pixel serving as one of a plurality of sub-pixels constituting each pixel displays a color that is able to be displayed by a simultaneous display of the other sub-pixels, a contrast ratio can be improved by controlling driving of the specific sub-pixel. Therefore, the same effects are obtained.

For example, the same effects are obtained even by an arrangement in which a pixel includes a red sub-pixel, a blue sub-pixel, and a purple specific sub-pixel and displays hues excluding green-tinged hues (hues from blue to red through purple). However, as with each of the embodiments, it is possible to display any color as long as a pixel includes R, G, and B sub-pixels. Therefore, the present invention can be suitably applied to a television receiver, a monitor apparatus, and the like.

Further, for the purpose of a full-color display, each pixel may be provided with a non-white sub-pixel (e.g., a sub-pixel having a complementary color such as Y, M, or C) serving as a specific sub-pixel, even if the pixel is arranged so as to have R, G, and B sub-pixels.

In this case, the color of the specific sub-pixel is preferably white or a color with a highly visible hue so that the peak luminance can be improved. Examples of such a color include a green-tinged color (such as cyan or yellow). Among these colors, in order to improve the peak luminance, it is preferable that a white sub-pixel be provided as a specific sub-pixel as with each of the embodiments. On the other hand, for convenience of manufacturing (e.g., in order to prevent a color filter from causing unevenness), a non-white (e.g., cyan or yellow) sub-pixel may be provided as a specific sub-pixel.

Further, the above description explains a case where a specific sub-pixel serving as one of a plurality of sub-pixels constituting each pixel displays a color that is able to be displayed by a simultaneous display of the other sub-pixels. However, even when the specific sub-pixel displays the same color as the other pixels do, the first small region can be displayed more brightly than the second small region provided that a signal for driving a sub-pixel contained in each of the small regions other than the first small region is set to limit the luminance of the specific sub-pixel as compared to a signal for driving a sub-pixel contained in the first small region. This allows the display screen of the display apparatus to display a clearer, more realistic, and more appealing image. In this case, as the color of the specific sub-pixel in the arrangement in which each pixel has R, G, and B sub-pixels, the color with a highly visible hue (e.g., G) can be suitably adopted. Further, even in cases where the color of the specific sub-pixel is set to be green, the brightness can be improved more efficiently by setting the color of the specific sub-pixel to be green lighter (to have a higher transmittance) than the colors of the other sub-pixels.

However, as with the present embodiment, when a specific sub-pixel serving as one of a plurality of sub-pixels constituting each pixel is arranged so as to display a color that is able to be displayed by a simultaneous display of the other sub-pixels, the range of usable colors (wavelengths) becomes wider, so that the brightness can be improved more effectively. Furthermore, faithful color reproduction is not required in a region expressed as a peak luminance. However, it is more preferable that no hue be caused in an unintended direction. Therefore, for the purpose of not greatly losing a color balance and of improving the brightness, it is more preferable that the aforementioned arrangement is adopted as with the present embodiment.

Furthermore, the above description explains a case where there are provided a first generating section 31 and a second generating section 32 that is driven to limit the luminance of a specific sub-pixel as compared to the first generating section 31 and where a method for driving a first small region or a method for driving a second small region is selected depending on which of the first and second generating sections 31 and 32 is driven in driving each small region. However, the present invention is not limited to this.

For example, there may be provided a first generating section and a second generating section that, even when receiving a video signal identical to that received by the first generating section, is to be driven to generate, for example, by converting an inputted gradation into a low value by a predetermined procedure, a signal whose luminance is lower than that of a signal generated by the first generating section. In this case, a method for driving a first small region or a method for driving a second small region may be selected depending on which of the generating sections is driven.

In either case, it is only necessary to divide a display region into a plurality of small regions, control a gradation luminance characteristic of each of the small regions, and set the luminance of a desired small region to be low. More specifically, the same effects are obtained by the following device for driving an image display apparatus, including control means for dividing a display region into small regions and controlling a gradation luminance characteristic of each of the small regions, the device, including: judging means for (i) evaluating, in accordance with an input signal by which each pixel is displayed, a relative brightness of each of the small regions into which the display region has been divided, and (ii) judging whether or not a display screen has a first small region that is brighter by a predetermined degree than other small regions, the control means controlling a gradation luminance characteristic of each of the small regions so that (a) a white luminance of each of the small regions becomes lower than that of the first small region when it is judged that the display screen has no first small region and (b) a white luminance of each of small regions other than a first small region becomes lower than that of the first small region when it is judged the display screen has the first small region.

Even in this case, in cases where the display screen has a first small region that is brighter than the other small regions by a predetermined degree, the white luminance of the first small region can be made higher than the white luminance of each of the small regions which white luminance is obtained when it is judged that the display screen has no first small region, and the white luminance of the first small region can be made higher than the white luminance of each of the other small regions which white luminance is obtained when it is judged the display screen has the first small region.

Therefore, in cases where a display of an image containing a strikingly bright small region (first small region) is indicated, the small region can be displayed more strikingly brightly than (i) the other regions of the image and (ii) each small region of the image which small region contains no strikingly bright small region, so that the image can be displayed with a high contrast ratio. This allows the display screen of the display apparatus to display a clearer, more realistic, and more appealing image.

INDUSTRIAL APPLICABILITY

The present invention allows a strikingly bright small region (first small region) to be displayed more strikingly brightly, and allows a display screen of a display apparatus to display a clearer, more realistic, and more appealing image. Therefore, the present invention can be suitably used to drive various display apparatuses such as a liquid crystal television receiver and a liquid crystal monitor apparatus.

The invention claimed is:

1. A device for driving a display apparatus including a display screen which has a plurality of pixels, each of the pixels having a plurality of sub-pixels for displaying different colors in accordance with (i) whether a color filter is provided or (ii) a color of the color filter, specific one of the sub-pixels, which constitute each of the pixels, displaying a color that is able to be displayed by one or more sub-pixels other than the specific sub-pixel, the device, comprising:

first generating means for generating, in accordance with an input signal indicative of a color to be displayed by each of the pixels, a signal for driving each of the sub-pixels;

second generating means for generating, in accordance with an input signal indicative of a color to be displayed by each of the pixels, a signal for driving each of the sub-pixels so as to limit a luminance of the specific sub-pixel as compared to the first generating means, the input signals being identical to each other, control means for (a) dividing the display screen into small regions, (b) evaluating a relative brightness of each of the small regions in accordance with an input signal by which each of the pixels is displayed, (c) judging whether or not the display screen has a first small region that is brighter by a predetermined degree than other small regions, (d) causing the first generating means to generate a signal for driving a sub-pixel contained in the first small region, and (e) causing the second generating means to generate a signal for driving a sub-pixel contained in each of other remaining small regions.

2. The device as set forth in claim 1, wherein each of the pixels includes a W sub-pixel serving as a specific sub-pixel, an R sub-pixel, a G sub-pixel, and a B sub-pixel.

3. The device as set forth in claim 2, wherein:

the second generating means resets a gradation signal indicative of a luminance of the W sub-pixel to a predetermined value for use in a dark display; and the first generating means sets a gradation signal indicative of a luminance of the W sub-pixel to a value, indicated by the input signal, which varies depending on a luminance of a pixel containing the W sub-pixel.

4. The device as set forth in claim 2, wherein the first generating means has a $\gamma$ characteristic whose $\gamma$ value is set to be greater than that of the second generating means.

5. The device as set forth in claim 2, wherein the control means judges, as the first small region, a small region in which a proportion of pixels each having a luminance that is higher by a predetermined level than an in-plane average luminance of the display screen is not less than a predetermined proportion.

6. The device as set forth in claim 5, wherein the control means changes the predetermined level in accordance with a standard deviation in luminance of each of the pixels in the display screen.

7. The device as set forth in claim 5, wherein, when the pixels have a luminance lower than a predetermined value, the control means treats the pixels to have a luminance of not more than the predetermined level, regardless of a result of evaluating the luminance of the pixels with respect to the in-plane average luminance.

8. The device as set forth in claim 5, wherein the control means (i) divides each of the small regions into small blocks each including a plurality of pixels, and (ii) makes a judgment in accordance with an average luminance of each of the small blocks instead of the luminance of the pixel.

9. The device as set forth in claim 2, wherein the control means makes, on a gradation value basis, a judgment for each of the small regions as to whether or not the small region is a first small region.

10. The device as set forth in claim 2, wherein the small region occupies, in the display screen, 1/64 or smaller of an area of the display screen.

* * * * *